US011187010B1

(12) United States Patent
Liang

(10) Patent No.: US 11,187,010 B1
(45) Date of Patent: Nov. 30, 2021

(54) FORCED-ENTRY-RESISTANT SASH LOCK

(71) Applicant: Vision Industries Group, Inc., So. Plainfield, NJ (US)

(72) Inventor: Luke Liang, So. Plainfield, NJ (US)

(73) Assignee: Vision Industries, Inc., So. Plainfield, NJ (US)

( * ) Notice: Subject to any disclaimer, the term of this patent is extended or adjusted under 35 U.S.C. 154(b) by 194 days.

(21) Appl. No.: 16/689,118

(22) Filed: Nov. 20, 2019

Related U.S. Application Data

(60) Provisional application No. 62/902,447, filed on Sep. 19, 2019.

(51) Int. Cl.
*E05B 17/20* (2006.01)
*E05B 9/02* (2006.01)
*E05B 65/08* (2006.01)

(52) U.S. Cl.
CPC ..... *E05B 17/2084* (2013.01); *E05B 9/02* (2013.01); *E05B 65/0841* (2013.01); *E05Y 2900/148* (2013.01)

(58) Field of Classification Search
CPC .... E05B 17/2084; E05B 9/02; E05B 65/0841; E05B 65/0876; E05B 65/0823;
(Continued)

(56) References Cited

U.S. PATENT DOCUMENTS 16,228 A 12/1856 Copeland
30,408 A 10/1860 Judd
(Continued)

FOREIGN PATENT DOCUMENTS

GB 2 286 627 8/1995
GB 2 461 079 12/2009
(Continued)

OTHER PUBLICATIONS

Press Fit Forces Stress Design Calculator, Jun. 18, 2018, available at: www.engineersedge.com/calculators/machine-design/press-fit/press-fit.htm.
(Continued)

*Primary Examiner* — Christine M Mills
*Assistant Examiner* — Yahya Sidky
(74) *Attorney, Agent, or Firm* — Thomas A. O'Rourke; Bodner & O'Rourke LLP

(57) ABSTRACT

A forced-entry resistant sash lock includes a housing, a shaft pivotally mounted to the housing, a cam mounted on the shaft using an elongated opening permitting selective rotational and translational movements, and a separation member secured to the shaft. In the unlocked position, upon shaft rotation in a first direction a cam surface on the separation member engages a follower surface on the cam causing co-rotation of the cam into a non-forced entry-resistant locked position, and upon continued rotation the cam surface moves relative to the follower surface causing cam translation into a forced-entry-resistant locked position through movement of the shaft within the elongated opening, until an engagement surface of the separation member engages a contact surface of the cam, preventing forced reverse cam translation. The cam translation causes a cam stop surface to engage a housing stop surface preventing forced cam counter-rotation.

12 Claims, 24 Drawing Sheets

(58) Field of Classification Search
CPC ..... E05Y 2900/148; Y10T 292/1039; Y10T 292/104; Y10T 292/1041; Y10T 292/0802; Y10S 292/20; Y10S 292/47; E05C 17/48; E05C 17/60; E06B 3/5063
See application file for complete search history.

(56) References Cited

U.S. PATENT DOCUMENTS 36,524 A 9/1862 Minor
51,222 A 11/1865 Ridell
108,778 A 11/1870 Gorman
115,781 A 6/1871 Steele
126,872 A 5/1872 Buckman
148,857 A 3/1874 Smith
163,008 A 5/1875 Gillespie
166,842 A 8/1875 Berryman
178,360 A 6/1876 Cooper
190,074 A 4/1877 Penfield
192,614 A 7/1877 Andrews
192,919 A 7/1877 Hoyt
201,146 A 3/1878 Adler
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
368,595 A 8/1887 King
369,885 A * 9/1887 Shaw ..... E05B 17/0025 292/65
375,656 A * 12/1887 Shaw ..... E05B 17/0025 292/65
376,252 A 1/1888 McIntyre
379,910 A 3/1888 Rosentreter
410,728 A 9/1889 Brown
417,868 A 12/1889 Janes
423,761 A 3/1890 Hasenpflug
426,303 A 4/1890 McGovern
447,068 A 2/1891 Dixon
402,723 A 5/1891 Schmalhausen
471,363 A 3/1892 Sloan
480,148 A 8/1892 Theby
493,159 A 3/1893 Gibson
509,941 A 12/1893 Perry
512,593 A 1/1894 Webster
520,754 A * 5/1894 Burmeister ..... E05B 17/0025 292/65
526,118 A 9/1894 Sharp
528,656 A 11/1894 Burmeister
530,078 A 12/1894 Ammerman
534,185 A 2/1895 Winchester
537,258 A 4/1895 Wicox
539,030 A * 5/1895 Bitner ..... E05C 19/105 292/111
551,181 A 12/1895 Dillon
551,242 A 12/1895 Wallace
554,448 A 2/1896 Kei
564,426 A 7/1896 Hubbard
572,591 A 12/1896 Woodard
587,424 A 8/1897 Bonine
590,225 A 9/1897 Hill
653,458 A 7/1900 Paquette
666,596 A 1/1901 Breen
683,928 A 10/1901 Geraghty
688,491 A 12/1901 Sigler
695,736 A 3/1902 Kendrick
698,742 A 4/1902 Schwarnweber
699,696 A 5/1902 Mellen
708,406 A 9/1902 Robison
714,343 A 11/1902 Weilman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenpflug
745,888 A 12/1903 McElwee
749,469 A 1/1904 Assorati
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Hearnshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A 1/1909 Petrie
913,730 A 3/1909 Kapus
926,899 A 7/1909 Roy
928,408 A 7/1909 Taube
948,628 A 2/1910 Jefferis
959,150 A 5/1910 Morris
963,983 A 7/1910 Bernhard
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilbum
1,051,918 A 2/1913 Rowley
1,059,999 A 4/1913 James
1,069,079 A 7/1913 Voight
1,077,487 A 11/1913 Miller
1,080,172 A 12/1913 Rusk
1,100,820 A 6/1914 Edwards
1,121,228 A 12/1914 Burkhart
1,122,026 A 12/1914 O'Rourke
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Holllis
1,243,115 A 10/1917 Shur
1,244,725 A 10/1917 Gadke
1,253,810 A 1/1918 Cianninoto
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditiefsen
1,338,250 A 4/1920 Parkes
1,338,416 A 4/1920 Bellinger
1,339,362 A 5/1920 L'Heureux
1,341,234 A 5/1920 Horton

(56) References Cited

U.S. PATENT DOCUMENTS 1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,470,858 A 10/1923 Maxwell
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilbert
1,605,717 A 11/1926 Gregg
1,619,031 A 3/1927 Ostrosky
1,622,742 A 3/1927 Shipman
1,656,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,877,177 A 9/1932 Hinderer
1,891,940 A 12/1932 McAllister
1,900,936 A 3/1933 Huttger
1,901,974 A 3/1933 Macy
1,918,114 A 7/1933 Lorenzen
1,922,062 A 8/1933 Sullivan
1,940,084 A 12/1933 Grasso
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stiilman
2,202,561 A 5/1940 Lahiere
2,232,965 A 2/1941 Perl
2,272,145 A 2/1942 Anderson
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 Menns
2,503,370 A 4/1950 Zanona
2,523,559 A 9/1950 Couture
2,537,736 A 1/1951 Carlson
2,537,738 A 1/1951 Schemansky
2,560,274 A 7/1951 Cantelo
2,581,816 A 1/1952 Schlueter
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostadal
2,645,515 A 7/1953 Thomas
2,648,967 A 8/1953 Holmsten
2,670,982 A 3/1954 Banham
2,692,789 A 10/1954 Rivard
2,735,707 A 2/1956 Sylvan
2,758,862 A 8/1956 Endter
2,766,492 A 10/1956 Day
2,789,851 A 4/1957 Lickteig
2,818,919 A 1/1958 Sylvan
2,846,258 A 8/1958 Granberg
2,855,772 A 10/1958 Hillgren
2,884,276 A 4/1959 Baptist
2,920,914 A 1/1960 Jenkins
2,941,832 A 6/1960 Grossman
2,997,323 A 8/1961 Riser
3,027,188 A 3/1962 Eichstadt
3,122,387 A 2/1964 Wakelin
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armsrtong
3,425,729 A 2/1969 Bisbing
3,438,153 A 4/1969 Lemme
3,469,877 A 9/1969 Hutchison
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
3,930,678 A 1/1976 Alexander
4,054,308 A 10/1977 Prohaska
4,059,298 A 11/1977 Van Klompenburg
4,063,766 A 12/1977 Granberg
4,068,871 A 1/1978 Mercer
4,095,827 A 6/1978 Stavenau
4,095,829 A * 6/1978 Van Klompenburg ..... E05C 9/025 292/241
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,655,489 A 4/1987 Bisbing
4,736,972 A 4/1988 Mosch
4,801,164 A 1/1989 Mosch
4,813,725 A 3/1989 Mosch
4,824,154 A 4/1989 Simpson
4,826,222 A 5/1989 Davis
4,827,685 A 5/1989 Schmidt
4,893,849 A 1/1990 Schladt
4,922,658 A 5/1990 Goddens
4,923,230 A 5/1990 Simpson
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini

(56) References Cited

U.S. PATENT DOCUMENTS 5,087,087 A 2/1992 Vetter
5,087,088 A 2/1992 Milam
5,090,750 A 2/1992 Lindqvist
5,090,754 A 2/1992 Thompson
5,092,640 A 3/1992 Plummer
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,217,264 A 6/1993 Fier
5,219,193 A 6/1993 Piltingsrud
5,244,238 A 9/1993 Lindqvist
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,536,052 A 7/1996 Maier
5,553,903 A 9/1996 Prete
5,560,149 A 10/1996 Lafevre
5,575,116 A 11/1996 Carlson
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,806,900 A 9/1998 Bratcher
5,829,196 A 11/1998 Maier
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schulz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schultz
6,250,694 B1 6/2001 Weiland
6,279,266 B1 8/2001 Searcy
6,349,576 B2 2/2002 Subliskey
6,364,375 B1 4/2002 Szapucki
6,450,544 B2 9/2002 Rotondi
6,546,671 B2 4/2003 Mitchell
6,565,133 B1 5/2003 Timothy
6,568,723 B2 5/2003 Murphy
6,588,150 B1 7/2003 Wong
6,592,155 B1 7/2003 Lemley
6,607,221 B1 8/2003 Elliot
6,631,931 B2 10/2003 Magnusson
6,634,683 B1 10/2003 Brannan
6,688,659 B2 2/2004 Kobrehel
6,817,142 B2 11/2004 Marshik
6,848,728 B2 2/2005 Rotondi
6,871,885 B2 3/2005 Goldenberg
6,871,886 B2 3/2005 Coleman
6,877,784 B2 4/2005 Kelley
6,925,758 B2 8/2005 Petit
6,957,513 B2 10/2005 Pettit
6,983,963 B2 1/2006 Eslick
7,000,957 B2 2/2006 Lawrence
7,013,603 B2 3/2006 Eenigenburg
7,017,957 B2 3/2006 Murphy
7,036,851 B2 5/2006 Romig
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 1/2007 Liang
7,171,784 B2 2/2007 Eenigenburg
7,296,831 B2 11/2007 Generowicz
7,322,619 B2 1/2008 Nolte
7,322,620 B1 * 1/2008 Lawrence ..... E05B 17/208 292/240
7,407,199 B2 8/2008 Richardson
7,431,356 B2 10/2008 Liang
7,441,811 B2 10/2008 Lawrence
7,481,470 B2 1/2009 Eenigenburg
7,510,221 B2 3/2009 Eenigenburg
7,530,611 B2 5/2009 Liang
7,559,588 B2 7/2009 Liang
7,607,262 B2 10/2009 Pettit
7,637,544 B2 12/2009 Liang
7,665,775 B1 2/2010 Miller
7,699,365 B2 4/2010 Liang
7,922,223 B2 4/2011 Lawrence
7,976,077 B2 7/2011 Flory
8,205,919 B2 6/2012 Flory
8,205,920 B2 6/2012 Flory
8,220,846 B2 7/2012 Liang
8,231,148 B2 7/2012 Van Der Kooij
8,235,430 B2 8/2012 Liang
8,272,164 B2 9/2012 Albrecht
8,336,930 B2 12/2012 Liang
8,360,484 B2 1/2013 Liang
8,414,039 B2 4/2013 Liang
8,511,724 B2 8/2013 Liang
8,550,507 B2 10/2013 Barton
8,567,830 B2 10/2013 Liang
8,657,347 B2 2/2014 Liang
8,726,572 B2 5/2014 Derham
8,789,857 B2 * 7/2014 Liang ..... E05B 17/2019 292/111
8,789,862 B2 7/2014 Liang
8,833,809 B2 9/2014 Liang
8,844,985 B2 9/2014 Liang
8,870,244 B2 10/2014 Liang
8,881,461 B2 11/2014 Derham
9,103,144 B2 8/2015 Liang
9,140,033 B2 9/2015 Wolf
9,376,834 B2 6/2016 Liang
9,493,970 B2 11/2016 Campbell
9,816,300 B2 11/2017 Derham
2006/0192391 A1 8/2006 Pettit
2006/0244270 A1 11/2006 Rotondi
2007/0205615 A1 9/2007 Eenigenburg
2008/0012358 A1 1/2008 Liang
2008/0022728 A1 1/2008 Flory
2008/0169658 A1 7/2008 Wolf
2009/0265996 A1 * 10/2009 Flory ..... E05C 3/046 49/394
2010/0199726 A1 8/2010 Varney
2010/0218425 A1 9/2010 Nolte
2010/0263415 A1 10/2010 Ruspil
2012/0313386 A1 * 12/2012 Liang ..... E05B 3/04 292/224
2013/0214545 A1 8/2013 Wolf
2013/0283695 A1 10/2013 Hollermann
2016/0060920 A1 * 3/2016 Liang ..... E05C 3/045 292/165

(56) References Cited

U.S. PATENT DOCUMENTS

| | | | | |
|---|---|---|---|---|
| 2016/0076282 | A1* | 3/2016 | Wolf | E05C 3/046<br>292/241 |
| 2018/0230710 | A1* | 8/2018 | Liang | E05B 65/0841 |

FOREIGN PATENT DOCUMENTS

| | | |
|---|---|---|
| GB | 2 461 107 | 12/2009 |
| GB | 2 461 108 | 12/2009 |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

* cited by examiner

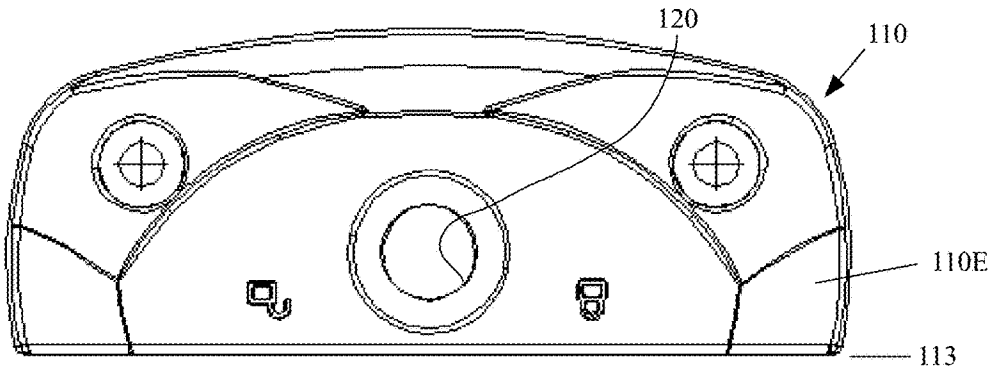
FIG. 8
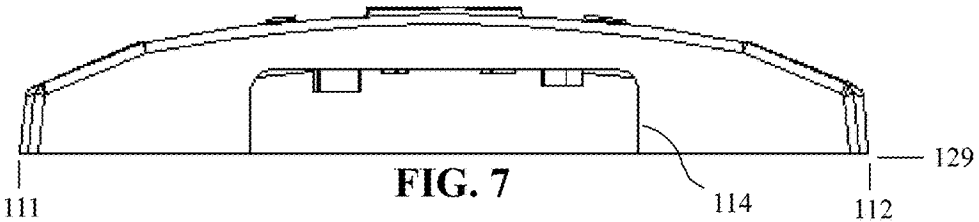
FIG. 7
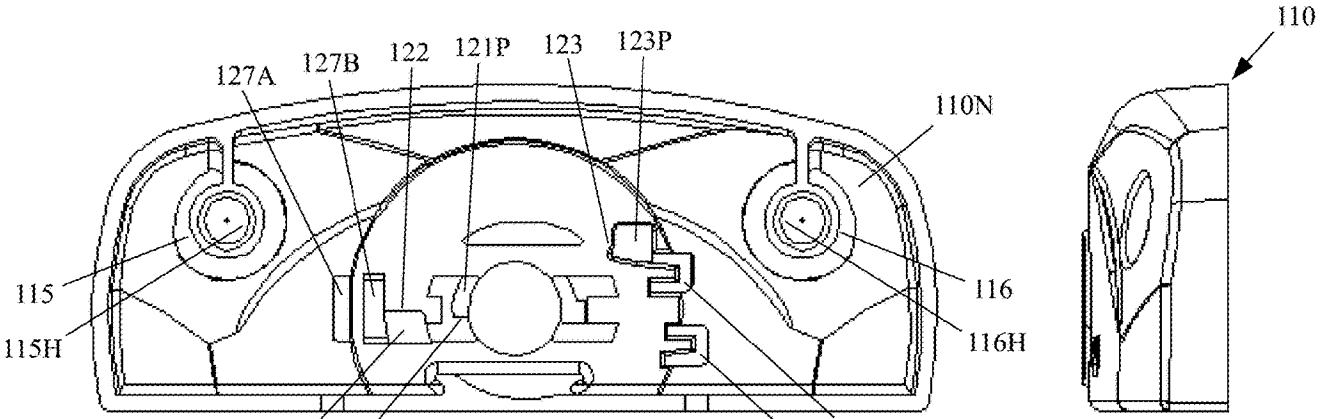
FIG. 9
FIG. 10

FIG. 88 (Cam Extended-FER Locked Cam Position)

FORCED-ENTRY-RESISTANT SASH LOCK

CROSS REFERENCES TO RELATED APPLICATIONS

This application claims priority on U.S. Provisional Application Ser. No. 62/902,447, filed on Sep. 9, 2019, having the title "Zinc LPC FER Lock," the disclosures of which are incorporated herein by reference.

FIELD OF THE INVENTION

The present invention is directed to the field of window locks, and more particularly is directed to a sash window lock that is configured to resist a forced entry from the exterior.

BACKGROUND OF THE INVENTION

Single hung and double hung sliding windows are known in the art, and are often utilized in the construction of homes and other dwellings, and even offices. Sash locks are typically used to secure the lower sash window in a closed position, and may be used to secure both the upper and lower sash windows in a closed position when both are slidable within a master window frame. Most sash locks are mounted to the meeting rail of the lower sash window, and use a rotatable cam that may engage a keeper in a locked position, which keeper may be attached to the upper sash window or to the master window frame for a single-hung sash window.

The lock of the present invention is particularly configured for the cam that locks and engages the keeper, to resist a forced entry by a person attempting to manipulate the cam from the exterior to move it into an unlocked position to open the window.

OBJECTS OF THE INVENTION

It is an object of the invention to provide a lock that is capable of locking the lower sash of a sliding sash window, or of locking both the upper sash and the lower sash window, where both sashes are slidable.

It is another object of the invention to provide a cam window lock capable of locking one or more sashes of a sliding sash window.

It is a further object of the invention to provide a latch for preventing the cam of the sash lock from being surreptitiously operated by an unauthorized party on the outside of the window.

It is another object of the invention to provide a sash lock capable of resisting a forced entry from the outside of the window.

Further objects and advantages of the invention will become apparent from the following description and claims, and from the accompanying drawings.

It is noted that citing herein of any patents, published patent applications, and non-patent literature is not an admission as to any of those references constituting prior art with respect to the herein disclosed and/or claimed apparatus.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the disclosed apparatus, a forced-entry resistant sash lock for a sash window may broadly include a housing, a shat, a cam, and a separation member. The housing includes a wall shaped to form an exterior surface and an interior surface that defines a cavity, with a portion of the interior surface defining a stop surface; and a substantially cylindrical hole in the wall. The shaft may be substantially cylindrical and may be rotatably mounted in the substantially cylindrical hole in the wall of the housing. The shaft preferably has a graspable handle portion disposed roughly perpendicular to the axis of the shaft. The cam, the cam comprising a hub with an elongated opening (e.g., a slotted hole) configured to mount the cam on the substantially cylindrical shaft within the cavity of the housing for selective rotational and translational movement of the cam relative to the shaft. The selective rotational and translation movement is between a forced-entry-resistant locked cam position where a portion of the cam extends out from the housing cavity and engages a keeper to lock the sash window in a closed window position to inhibit sash window movement, a non-forced entry-resistant locked cam position where the portion of the cam still engages the keeper, and an unlocked position where the cam retracts into the housing and the portion of the cam disengages from the keeper. The cam also includes a first contact surface, a second contact surface, a follower surface between the first and second contact surfaces, and a stop surface. The separation member includes a substantially cylindrical hole, a first engagement surface, a second engagement surface, and a cam surface between the first and second engagement surfaces. The separation member is secured to the shaft whereby movement of the shaft causes corresponding movement of the separation member, with the securement configured for the first engagement surface, second engagement surface, and cam surface to respectively cooperate with the first contact surface, second contact surface, and follower surface, as described hereinafter.

When the cam is in the unlocked position, upon rotation of the shaft in a first rotational direction the cam surface engages the follower surface and causes co-rotation of the cam into the non-forced entry-resistant locked cam position, and upon continued rotation of the shaft in the first rotational direction the cam surface of the separation member subsequently moves relative to the follower surface and causes translation of the cam into the forced-entry-resistant locked cam position through movement of the shaft within the elongated opening, until the first engagement surface engages the first contact surface.

The translation of the cam causes the stop surface on the cam to engage the stop surface on the housing to prevent forced rotation of the cam; and the first engagement surface engaged with the first contact surface prevents forced translation of the cam.

When the cam is in the forced-entry-resistant locked cam position, upon counter-rotation of the shaft in a second rotational direction, corresponding counter-rotation of the separation member causes the first engagement surface to disengage from the first contact surface, and causes movement of the cam surface of the separation member relative to the follower surface to cause reverse translation of the cam from the forced-entry-resistant locked cam position to the non-forced entry-resistant locked cam position. Upon continued counter-rotation of the shaft, the second engagement surface contacts the second contact surface and causes co-counter-rotation of the cam from the non-forced entry-resistant locked cam position to the unlocked position.

The housing may include a second stop surface and the cam comprises a second stop surface, which may be configured so that the second stop surface of the cam may contact the second stop surface of the housing to limit (i.e., stop) the counter-rotation of the cam in the second direction upon reaching the non-forced entry-resistant locked cam position.

The housing may include a third stop surface and the cam comprises a third stop surface, which may be configured so that the third stop surface of the cam may contact the third stop surface of the housing to limit (i.e., stop) the rotation of the cam in the first direction upon reaching the unlocked position.

The forced-entry resistant sash lock may also include a leaf spring that may be configured to co-act with flat formed on the shaft to bias the shaft into the forced-entry-resistant locked cam position as the rotation of the shaft causes the cam to approach the forced-entry-resistant locked cam position, and to bias the shaft into the unlocked position as the counter-rotation of the shaft causes the cam to approach the unlocked position.

BRIEF DESCRIPTION OF THE DRAWINGS

The description of the various example embodiments is explained in conjunction with appended drawings, in which:

FIG. 7 is a front view of the housing of FIG. 3;

FIG. 8 is a top view of the housing of FIG. 3;

FIG. 9 is a bottom view of the housing of FIG. 3;

FIG. 10 is an end view of the housing of FIG. 3:

FIG. 88 is the cross-sectional view of FIG. 58 shown enlarged;

DETAILED DESCRIPTION OF THE INVENTION

Figure 1:
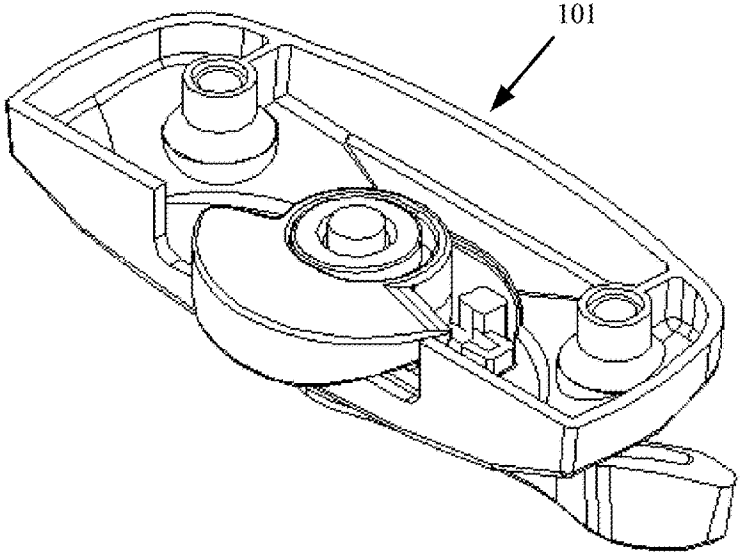
FIG. 1 is a bottom perspective view of the forced-entry-resistant sash lock assembly as disclosed herein.
Figure 2:
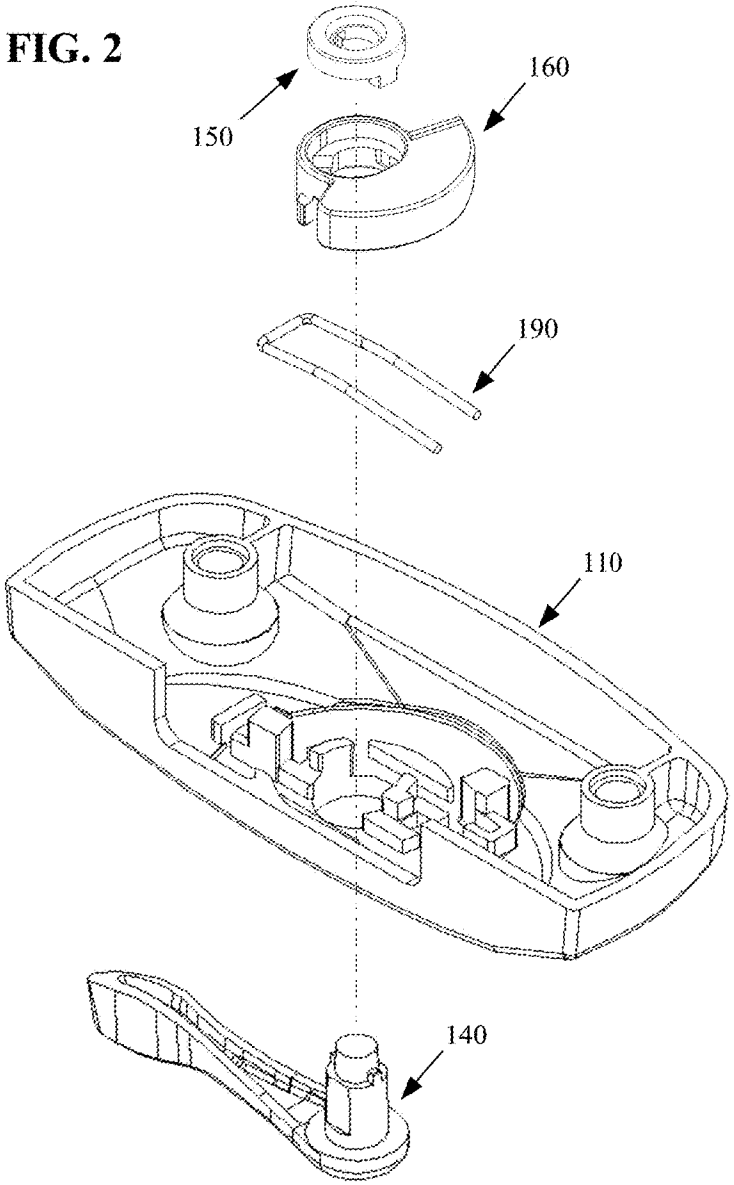
FIG. 2 is an exploded view of the parts that make up the forced-entry-resistant sash lock assembly of FIG. 1.
Figure 4:
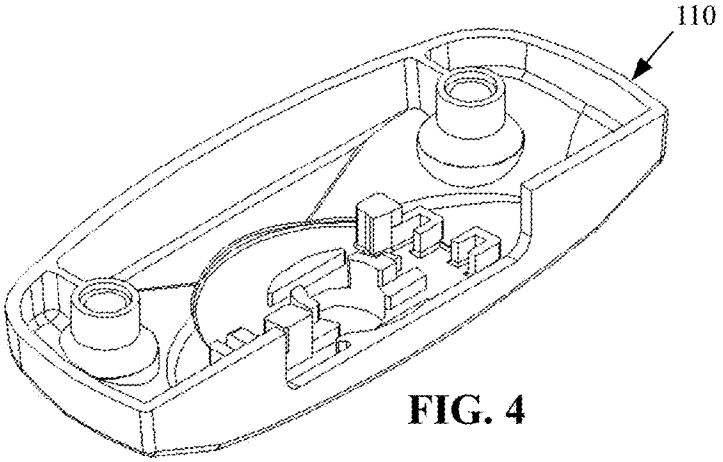
FIG. 4 is a first bottom perspective view of the housing of FIG. 3.
Figure 6:
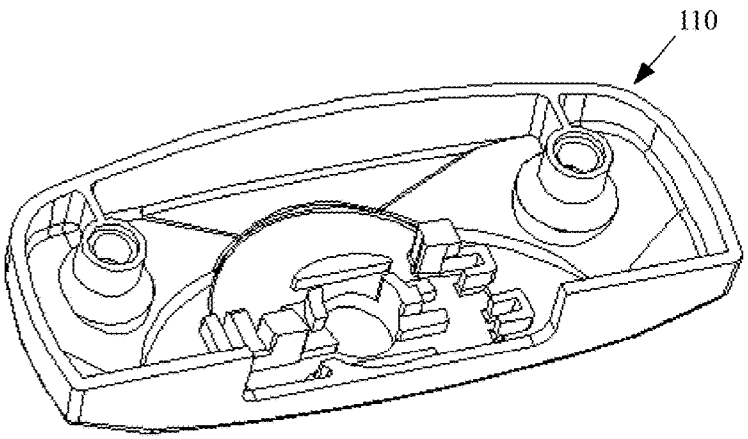
FIG. 6 is a third bottom perspective view of the housing of FIG. 3.
Figure 3:
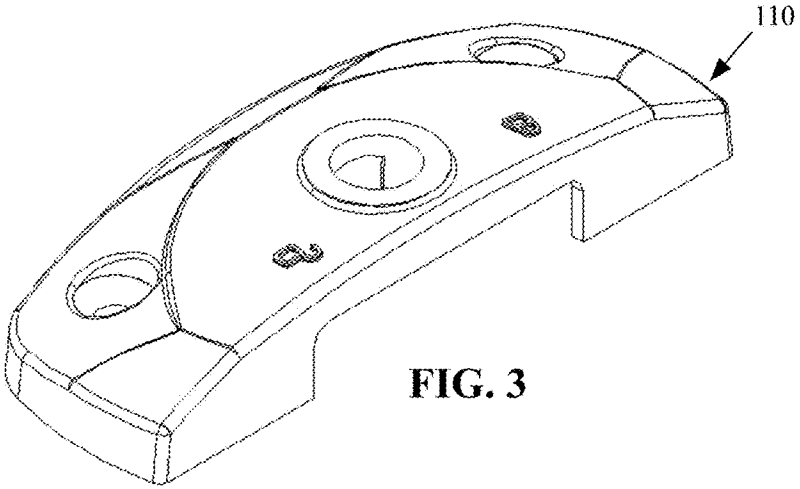
FIG. 3 is a top perspective view of the housing of the forced-entry-resistant sash lock assembly of FIG. 1.
Figure 5:
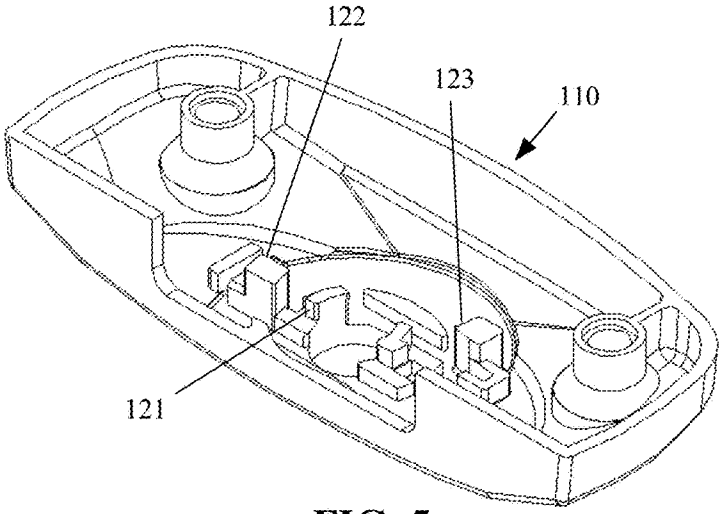
FIG. 5 is a second bottom perspective view of the housing of FIG. 3.
Figure 11:
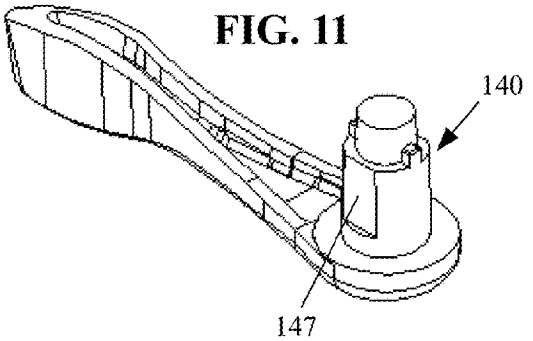
FIG. 11 is a first perspective view of the integrally formed shaft and handle member used for the forced-entry-resistant sash lock assembly of FIG. 1.
Figure 12:
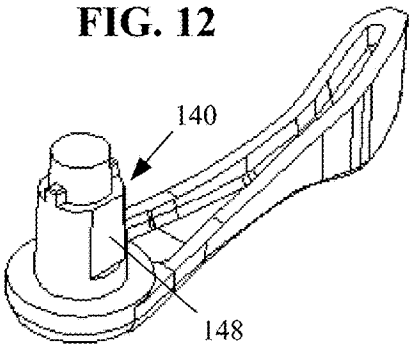
FIG. 12 is a second perspective view of the shaft and handle member used for the forced-entry-resistant sash lock assembly of FIG. 1.
Figure 14:
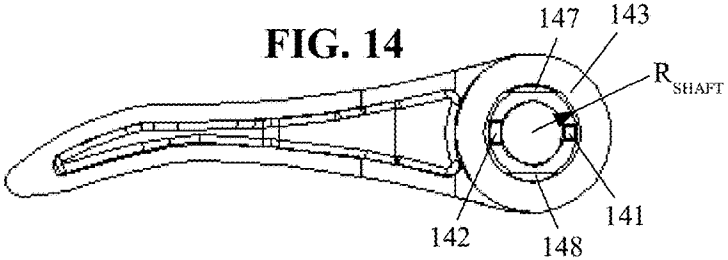
FIG. 14 is a bottom view of the shaft and handle member of FIG. 12.
Figure 13:
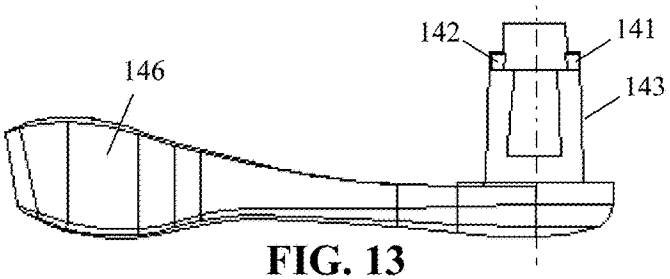
FIG. 13 is a front view of the shaft and handle member of FIG. 12.
Figure 15:
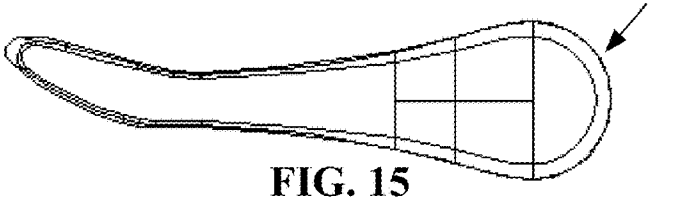
FIG. 15 is a top view of the shaft and handle member of FIG. 12.
Figure 16:
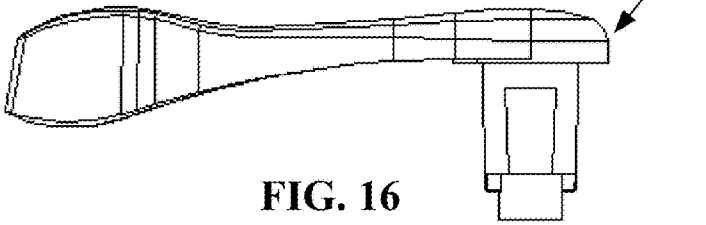
FIG. 16 is a rear view of the shaft and handle member of FIG. 12.
Figure 17:
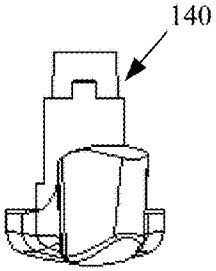
FIG. 17 is a first end view of the shaft and handle member of FIG. 12.
Figure 18:
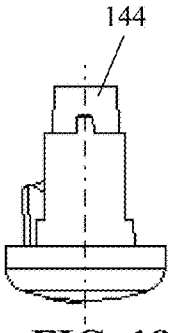
FIG. 18 is a second end view of the shaft and handle member of FIG. 12.
Figure 21:
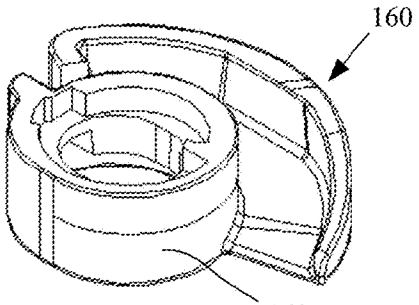
FIG. 21 is a third perspective view of the cam used for the forced-entry-resistant sash lock assembly of FIG. 1.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B. and C", and "A, B, and/or C" herein means all of the following possible combinations: A alone; or B alone; or C alone; or A and B together; or A and C together: or B and C together; or A. B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed and/or claimed apparatus/method.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) ofa multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit," available at www.mm-to.org/dclark/Reports/Encoder%20Upgrade/fittolerences%20%5BRead-Only%5D.pdf.

Also, the drawings of the lock presented herein are not necessarily to scale (i.e., a part feature that measures one inch on the printed patent application document may not necessarily be one inch long): however the relative sizes of features shown in the figures are accurately depicted as the patent drawings are derived from one or more three-dimensional computer graphics model(s) of the assembled lock and/or its component parts.

In accordance with at least one embodiment, a forced-entry-resistant sash lock 101 may broadly include a housing 110, a shaft/handle member 140, a separation member 150, a cam 160, and a biasing member 190. Another embodiment of the sash lock may eliminate the biasing member 190. The assembled forced-entry-resistant sash lock 101 is shown in the perspective view of FIG. 1, and the component parts that may be used for the sash lock 101 are shown in an exploded view in FIG. 1.

Figure 92:
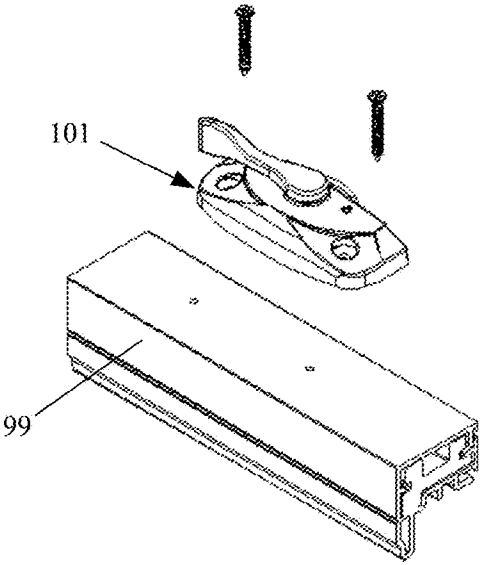
FIG. 92 is a perspective view showing the forced-entry-resistant sash lock assembly of FIG. 1 shown just prior to being secured to a meeting rail of a sash window using screws.
Figure 93:
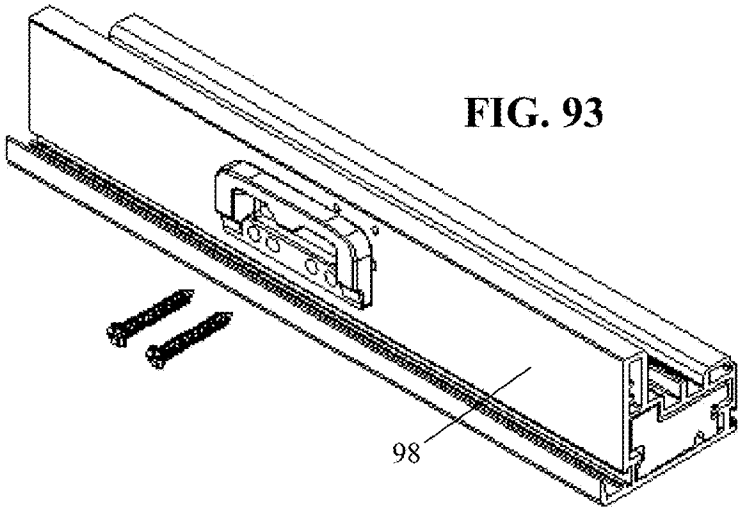
FIG. 93 is a perspective view showing the keeper used with the forced-entry-resistant sash lock assembly of FIG. 1, shown just prior to the keeper being secured to the master window frame or to a second meeting rail of a sash window using screws.
Figure 94:
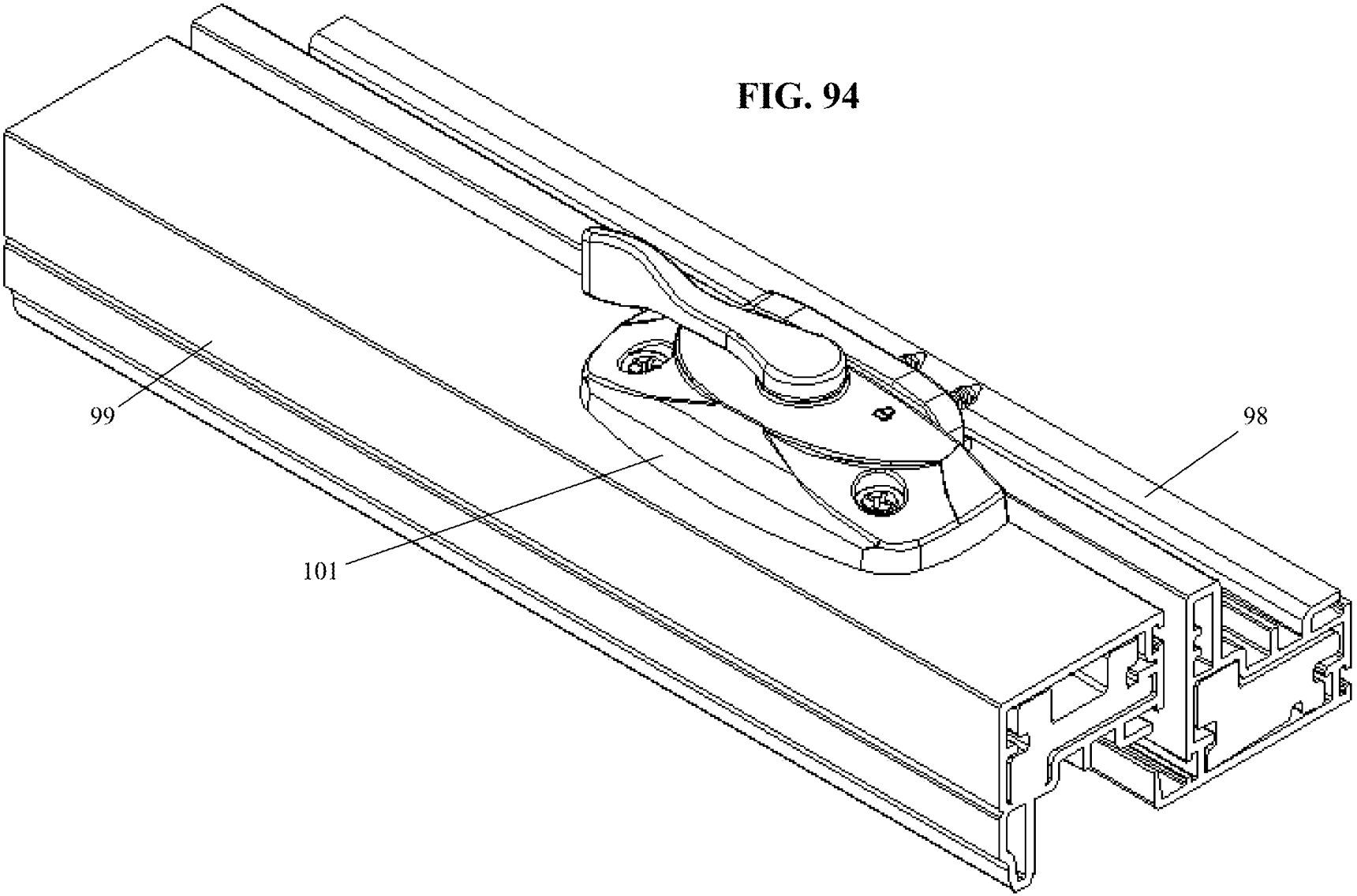
FIG. 94 is a perspective of the meeting-rail mounted forced-entry-resistant sash lock assembly with the shaft/handle member in the FER locked position for the cam to engage the window-frame mounted keeper, to lock the sash window and protect against a forced entry.

Perspective views of the housing 110 are shown in FIGS. 3-6, while corresponding orthogonal views are shown in FIGS. 7-10. The housing 110 is not limited to the shape illustrated within those figures and could take on many different suitable shapes, including a rectangular shape, an irregular shape, etc. However, the housing 110 may desirably be formed of at least one wall (e.g., from a machining, forging, or casting process) that may be shaped to form an exterior surface 110E, and an interior surface 110N that defines a cavity, and which wall may terminate in a generally flat bottom 129 that may be configured to rest upon the top of the meeting rail. The housing wall may span from a first end 111 to second end 112. The bottom surface 129 may be open into the cavity as shown, having an opening that leaves only the wall thickness. A side of the housing wall may also be shaped to form a generally flat surface 113, which may have an opening 114 that interconnects with the cavity, and through which the cam may protrude to engage the keeper and lock the sash window. The wall of housing 110 may have a first protrusion 115 and a second protrusion 116 that may extend into the cavity and may reach generally flat bottom 129, each of which protrusion may have a respective through hole 11511/116H formed therein for receiving a fastener for securing the sash lock 101 to the meeting rail of the sliding sash window 99 (see FIG. 92 and FIG. 94).

Figure 42:
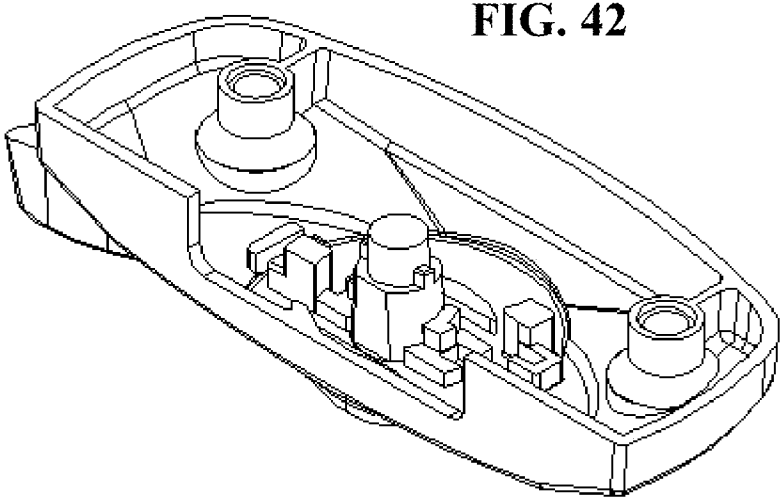
FIG. 42 is the perspective view of FIG. 41, shown after the shaft portion of the shaft/handle member has been pivotally received in an orifice in the housing.
Figure 41:
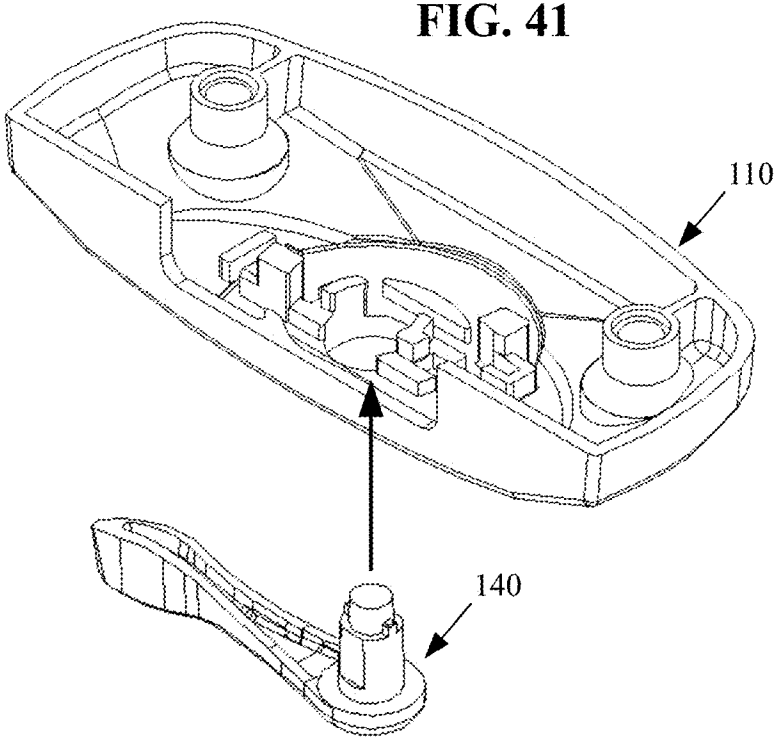
FIG. 41 illustrates the bottom perspective view of the housing of FIG. 5, shown just prior to pivotal mounting of the shat/handle member of FIG. 11 thereto.

The housing 110 may have a substantially cylindrical hole 120, which may be used for pivotal mounting of the shaft of the shaft/handle member 140 to the housing (see FIGS. 41-42). One or more additional protrusions may extend from the interior surface 110N of the housing wall into the cavity, which protrusion(s) may be used for controlling (i.e., limiting) movement of the cam 160 in three different ways, as discussed hereinafter. The protrusion(s) on the interior of the housing 110 may create a first stop surface 121, a second stop surface 122, and a third stop surface 123. There may be three separate protrusions (e.g., 121P, 1221P, and 123P—see FIG. 9 and FIGS. 88 and 91)—upon which those three stop surfaces 121/122/123 may be formed, or alternatively those three protrusions may be interconnected and essentially one single protrusion may be formed to include those three stop surfaces.

The interior surface 110N of the housing 110 may also be formed with support walls to retain one or more leaf springs that may be used to bias the cam. For example, as seen in FIG. 9, a C-shaped wall protrusion 125 may be formed on one end of the housing interior to retain a first end of a substantially straight leaf spring therein, and a similar oppositely facing C-shaped wall section may be formed on the other end to retain the other end of the leaf spring. Other arrangements for retaining a leaf spring therein are also possible (see e.g., Applicant's co-pending application Ser. No. 16/019,742).

In addition, rather than using a pair of straight leaf springs, a biasing member 190, as shown in FIGS. 36-40, may instead be utilized in the sash lock assembly 101. The biasing member 190 may be formed to have a first straight section 191, a second straight section 192, and a transverse section 193 that connects the two straight sections together.

Figure 44:
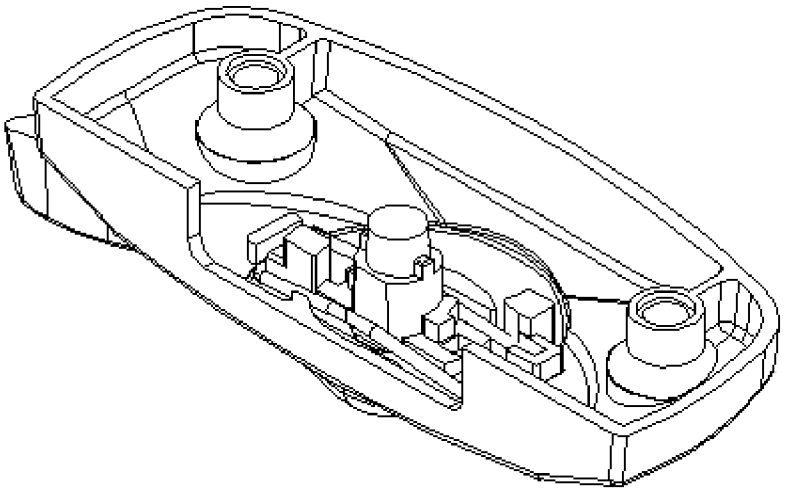
FIG. 44 is the perspective view of FIG. 43, shown after securing of the biasing member to the housing.
Figure 43:
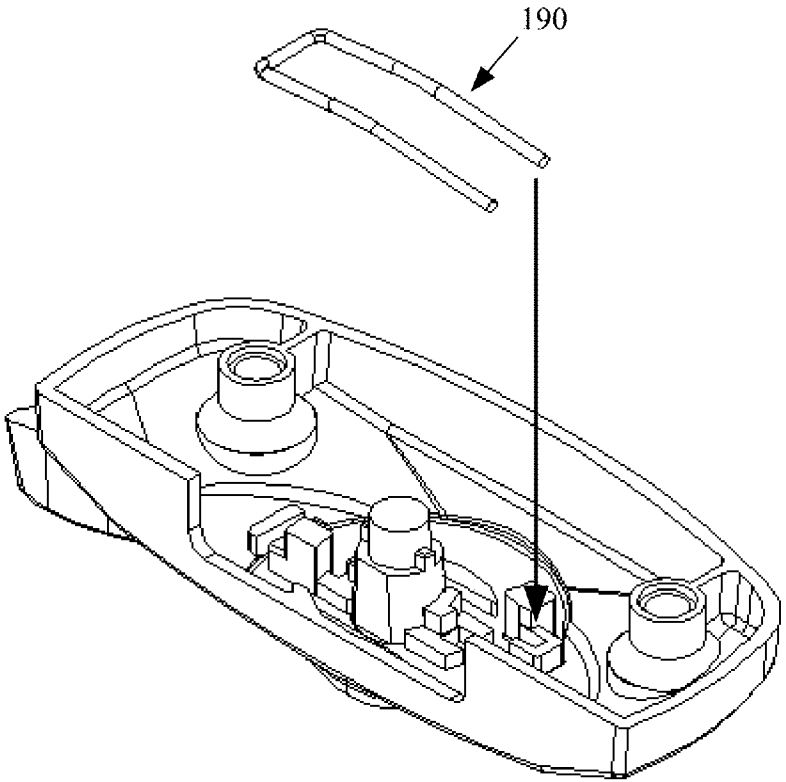
FIG. 43 is the perspective view of FIG. 42, shown just prior to securing of the biasing member of FIG. 36 to the housing.
Figure 46:
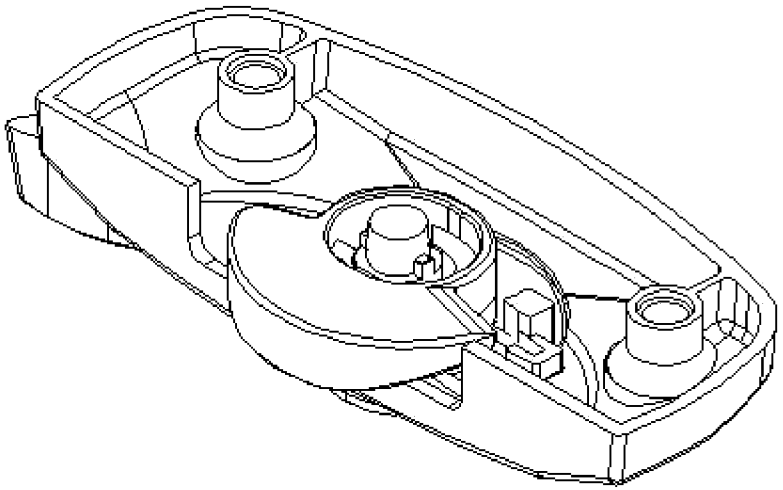
FIG. 46 is the perspective view of FIG. 45, shown after mounting of the cam onto the shaft portion of the shaft/handle member.
Figure 45:
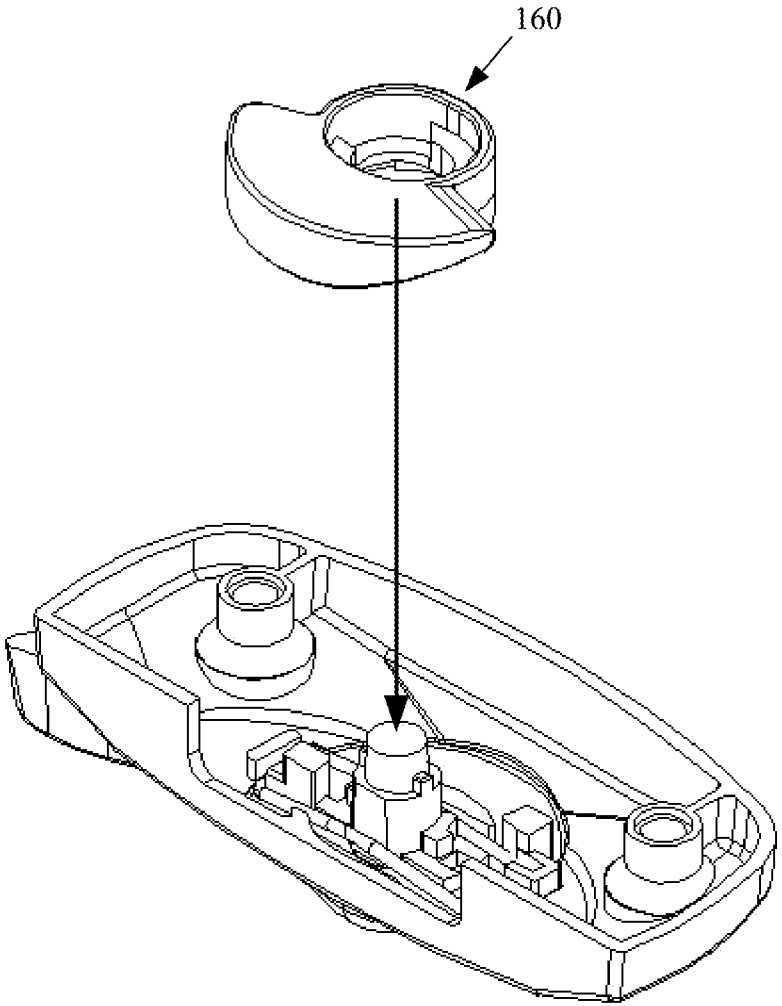
FIG. 45 is the perspective view of FIG. 44, shown just prior to mounting of the elongated opening of the cam of FIG. 20 onto the shaft portion of the shaft/handle member.
Figure 49:
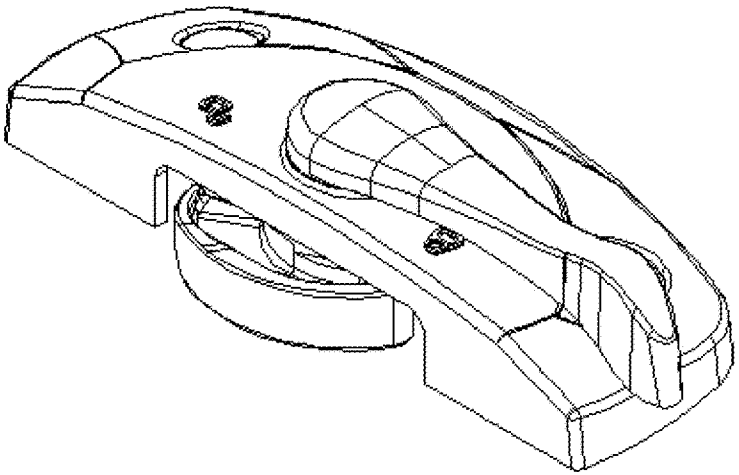
FIG. 49 is a top perspective view of the forced-entry-resistant sash lock assembly of FIG. 48.

Therefore, to support the biasing member 190 within the housing cavity, the interior surface 110N of the housing 110 may have a first C-shaped wall protrusion 125 and a second C-shaped wall protrusion 126 to support the first and second straight sections 191/192, and the housing may also have a pair of wall sections 127A and 127B that may support the transverse section 193 (see FIGS. 43-44).

Figure 48:
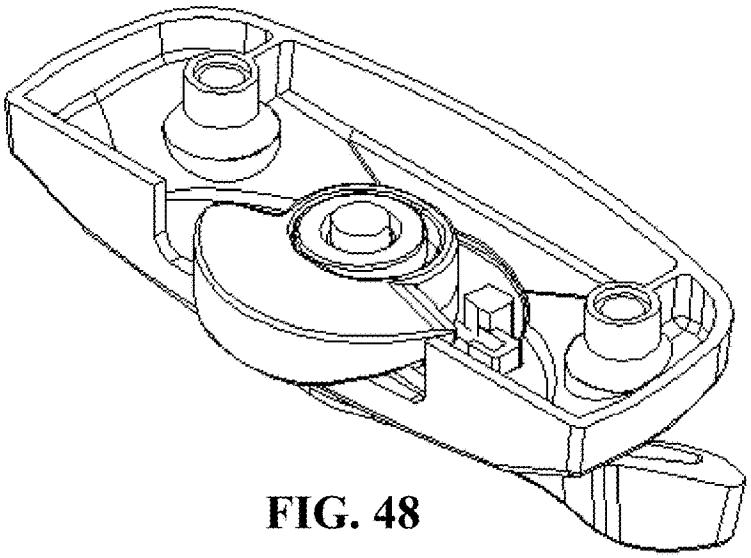
FIG. 48 is the bottom perspective view of the forced-entry-resistant sash lock assembly shown in FIG. 1.
Figure 47:
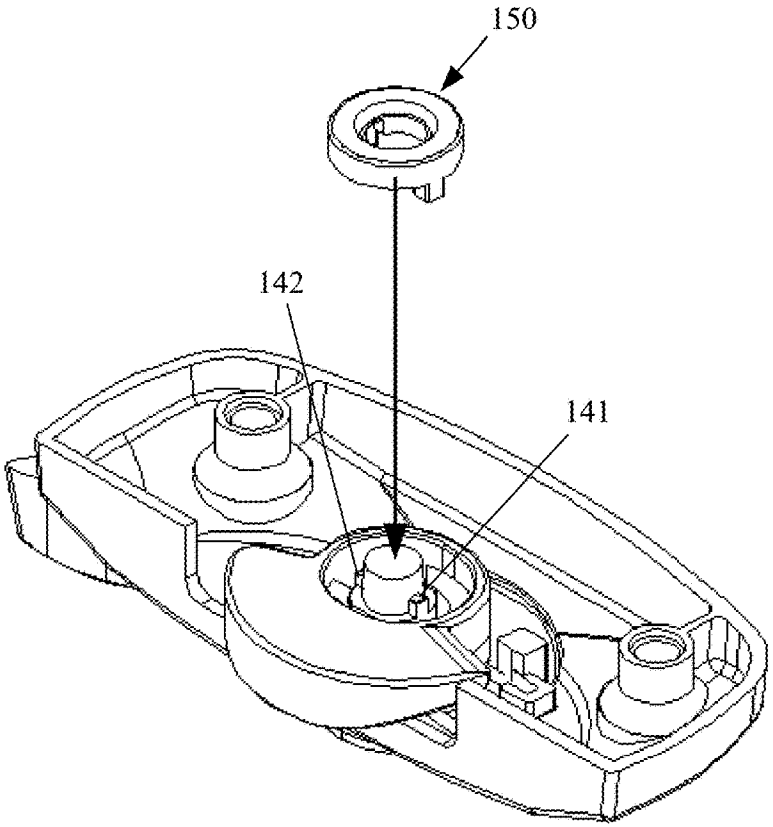
FIG. 47 is the perspective view of FIG. 46, shown just prior to mounting of the separation member of FIG. 29 onto the shaft portion of the shaft/handle member to be fixedly secured thereto, being positioned for selective engagement of the separation member with the cam.
Figure 53:
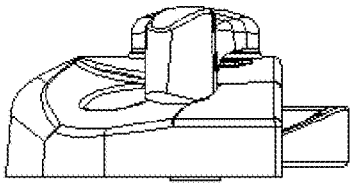
FIG. 53 is an end view of the forced-entry-resistant sash lock assembly of FIG. 49.
Figure 51:
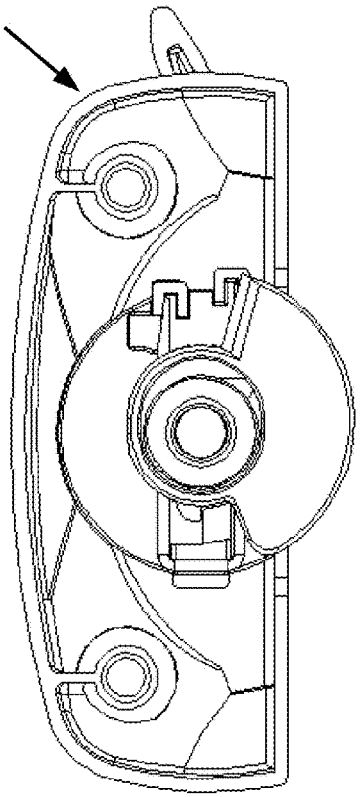
FIG. 51 is a bottom view of the forced-entry-resistant sash lock assembly of FIG. 49.
Figure 50:
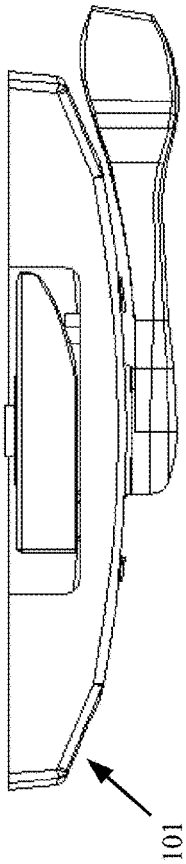
FIG. 50 is a front view of the forced-entry-resistant sash lock assembly of FIG. 49.
Figure 52:
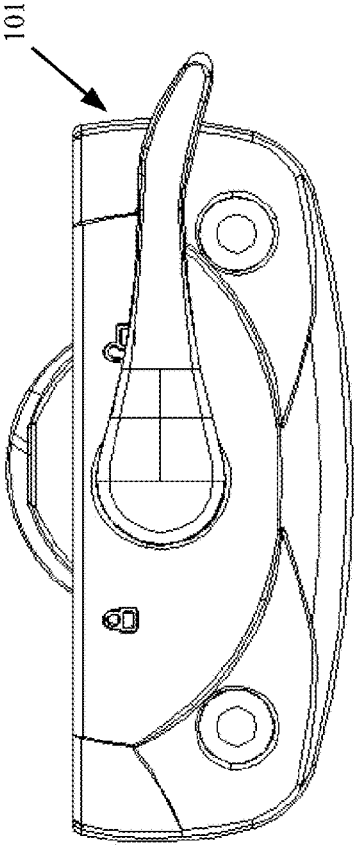
FIG. 52 is a top view of the forced-entry-resistant sash lock assembly of FIG. 49.
Figure 55:
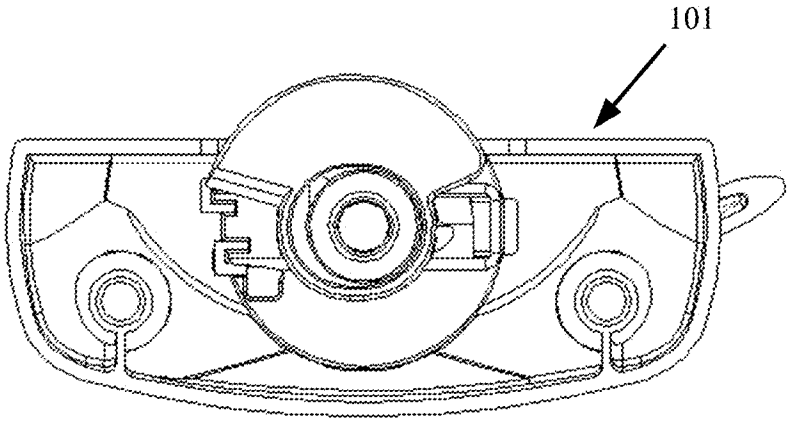
FIG. 54 and FIG. 55 are each the bottom view of the sash lock assembly, being shown respectively with the shaft/handle member and cam in the unlocked position, and in the forced-entry-resistant locked position.
Figure 54:
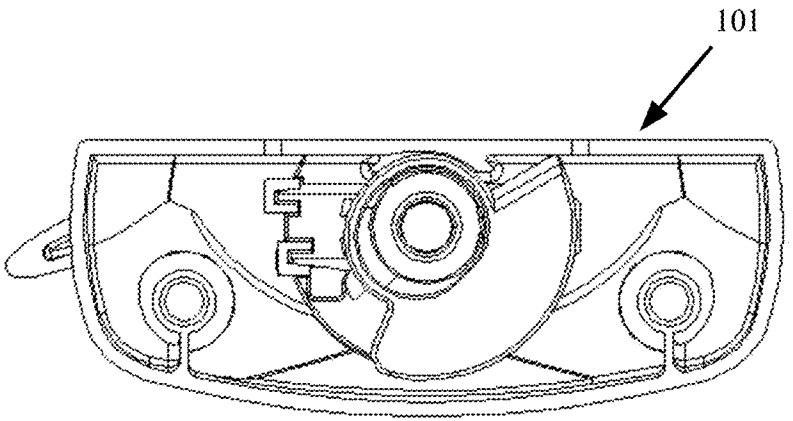
Figures 56, 57, 58, 59, 60, 61, 62, 63, 64, 65, 66, 67:
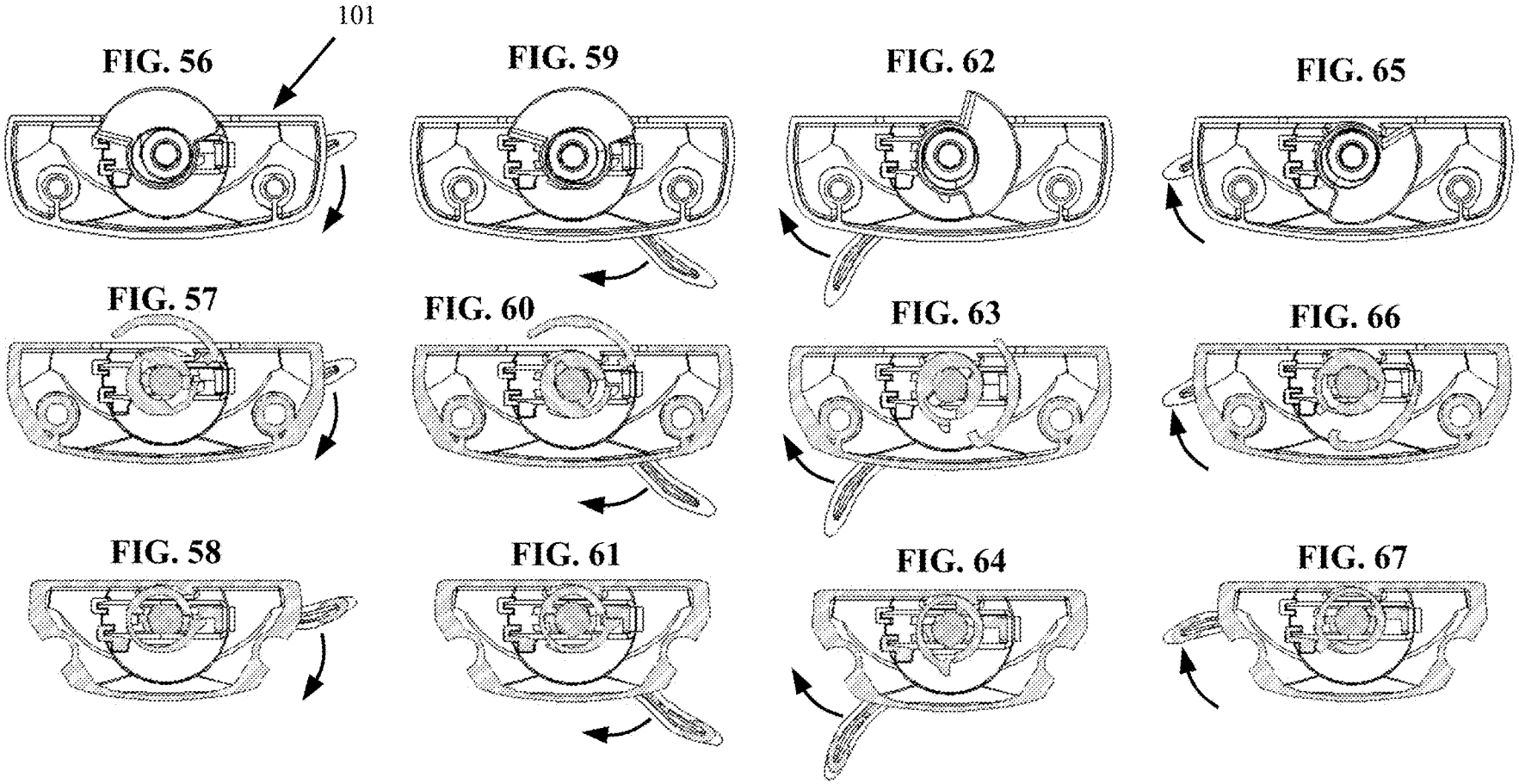
FIG. 56 is the bottom view of FIG. 55 with the shaft/handle member and cam of the sash lock assembly shown in the forced-entry-resistant locked position.
FIG. 57 is a cross-sectional view through the sash lock assembly of FIG. 56, showing the relative positioning and engagement/disengagement between the corresponding features of the separation member and the cam.
FIG. 58 is a second cross-sectional view through the sash lock assembly of FIG. 56, showing the relative positioning and engagement/disengagement between the corresponding features of the cam and the housing.
FIG. 59 is the bottom view of FIG. 56, but shown after the shaft/handle member and the separation member of the sash lock assembly have been rotated roughly 45 degrees away from the forced-entry resistant (FER) locked position into the non-FER locked position, being with translational movement of the cam but without co-rotation of the cam away from engagement of the keeper.
FIG. 60 is a cross-sectional view through the sash lock assembly as shown in FIG. 59, showing the relative positioning and engagement/disengagement between the corresponding features of the separation member and the cam.
FIG. 61 is a second cross-sectional view through the sash lock assembly as shown in FIG. 59, showing the relative positioning and engagement/disengagement between the corresponding features of the cam and the housing.
FIG. 62 is the bottom view of FIG. 59, but shown after the shat/handle member and the separation member of the sash lock assembly have been rotated roughly 90 degrees further away from the forced-entry resistant (FER) locked position (i.e., about 135 degrees of total rotation), being with co-rotation of the cam away from its engagement with the keeper at the non-FER locked position into a first retracted unlocked position.
FIG. 63 is a cross-sectional view through the sash lock assembly as shown in FIG. 62, showing the relative positioning and engagement/disengagement between the corresponding features of the separation member and the cam.
FIG. 64 is a second cross-sectional view through the sash lock assembly as shown in FIG. 62, showing the relative positioning and engagement/disengagement between the corresponding features of the cam and the housing.
FIG. 65 is the bottom view of FIG. 62, but shown after the shaft/handle member and the cam of the sash lock assembly have been rotated roughly 45 degrees further away from the forced-entry resistant (FER) locked position (i.e., about 180 degrees of total rotation), being with co-rotation of the cam away from the first retracted unlocked position into a second retracted unlocked position.
FIG. 66 is a cross-sectional view through the sash lock assembly of FIG. 65, showing the relative positioning and engagement/disengagement between the corresponding features of the separation member and the cam.
FIG. 67 is a second cross-sectional view through the sash lock assembly as shown in FIG. 65, showing the relative positioning and engagement/disengagement between the corresponding features of the cam and the housing.
Figure 68:
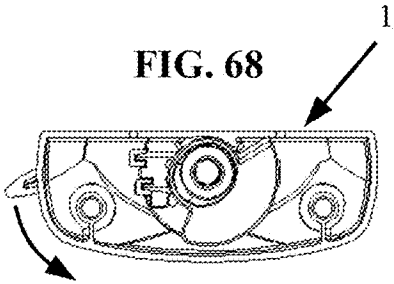
FIGS. 68-70 are the same as FIGS. 65-67, but with arrows therein indicating application of a force to the shaft/handle member to initiate counter-rotation of the cam away from the second retracted unlocked position towards the first retracted unlocked position.
Figure 69:
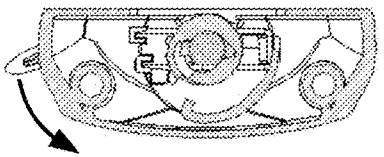
Figure 70:
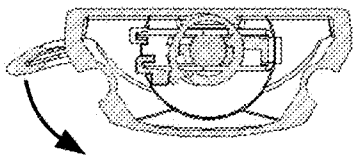
Figure 71:
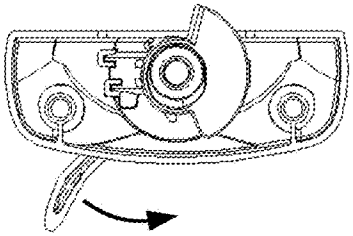
FIGS. 71-73 are the same as FIGS. 62-64, but with arrows therein indicating application of a force to the shaft/handle member to continue counter-rotation of the cam away from the first retracted unlocked position towards the non-FER locked position.
Figure 72:
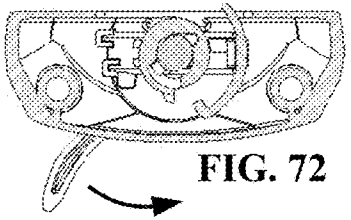
Figure 73:
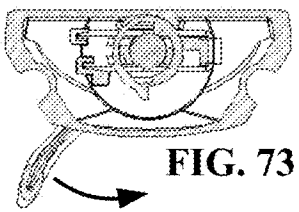
Figure 74:
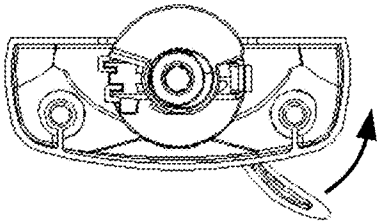
FIGS. 74-76 are the same as FIGS. 59-61, but with arrows therein indicating application of a force to the shaft/handle member to continue counter-rotation of the cam away from the non-FER locked position towards the FER locked position.
Figure 75:
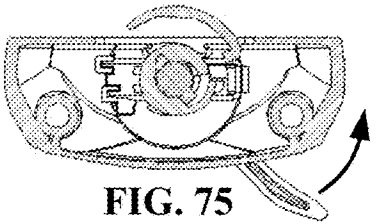
Figure 76:
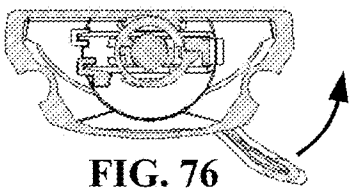
Figure 77:
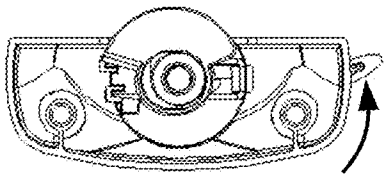
FIGS. 77-79 are the same as FIGS. 56-58, but with arrows therein indicating application of a force to the shaft/handle member to ultimately place the cam in the FER locked position.
Figure 78:
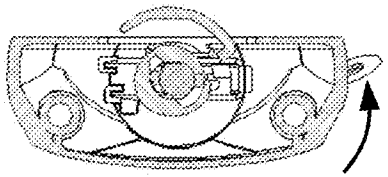
Figure 79:
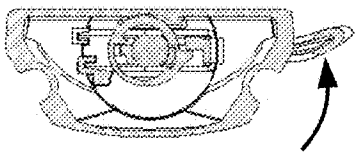
Figure 80:
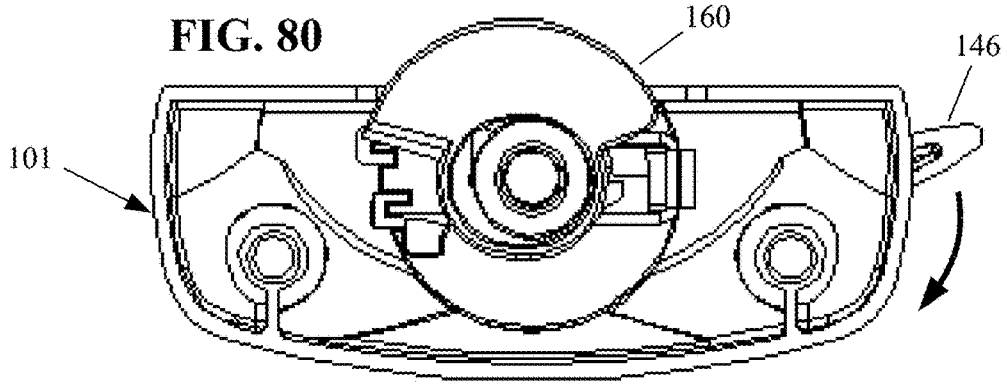
FIG. 80 is the cross-sectional view of FIG. 56 shown enlarged.
Figure 81:
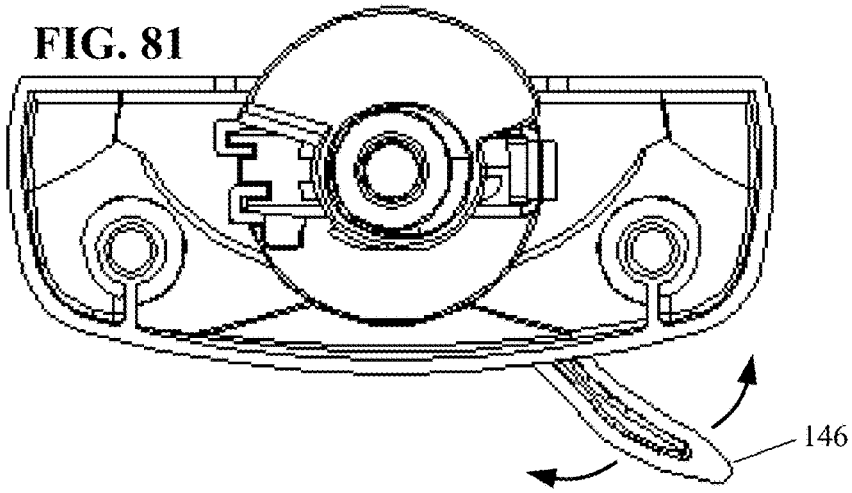
FIG. 81 is the cross-sectional view of FIG. 59 shown enlarged.
Figure 82:
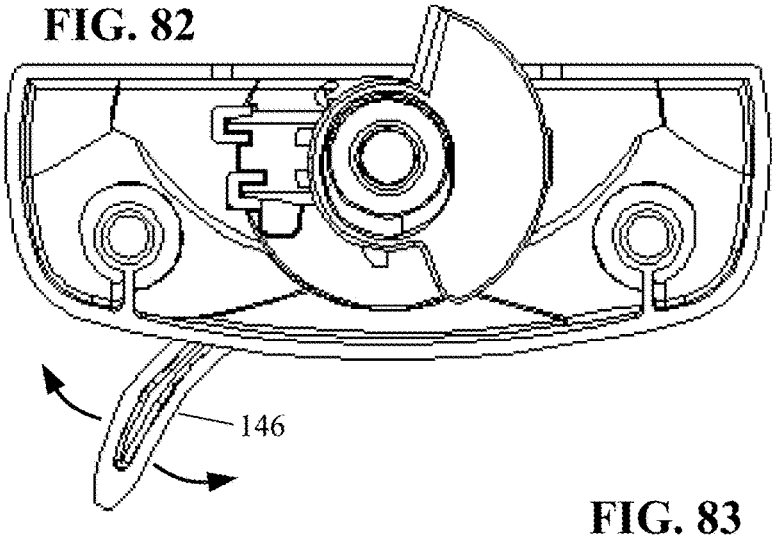
FIG. 82 is the cross-sectional view of FIG. 62 shown enlarged.
Figure 83:
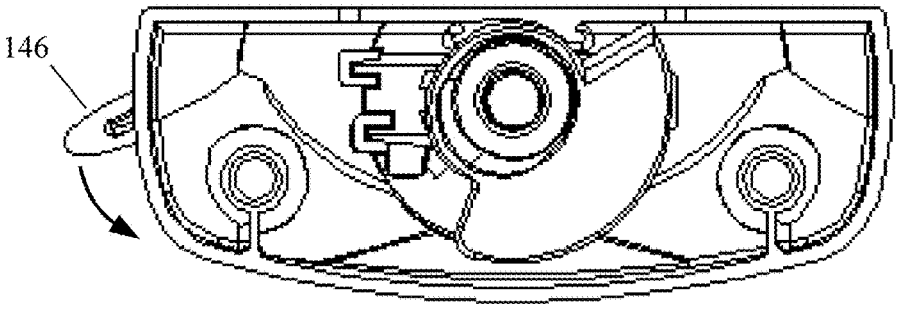
FIG. 83 is the cross-sectional view of FIG. 65 shown enlarged.

As seen in FIGS. 11-18, a shaft/handle member 140 may have a cylindrical shaft 143, having a radius $R_{SHAFT}$, which cylindrical shaft may be configured to be pivotally received within the hole 120 of the housing 110, for pivotal mounting of the shaft/handle member with respect to the housing. A first end of the shaft 143 may have a knob or other enlarged circular cross-sectional shape formed thereon to permit that end of the shaft to be easily grasped by the user. In another embodiment, the first end of the shaft 143 may have a graspable handle portion 146 that may extend generally orthogonally with respect to the axis of the cylindrical shaft. The second, free end of the shaft 143 may have a cylindrical protrusion 144 that protrudes therefrom, which may be sized and shaped to be bucked (i.e., upset) like a rivet, for mounting of the separation member 150 to the end of the shaft. Also, the shaft 143 may also have one or more protrusions (i.e., two protrusions 141 and 142) that may be received in corresponding recesses in the separation member 150 for the two parts to act as one (see FIGS. 47-48), without relying solely upon the strength of the riveted connection to resist torque. The shaft 143 may also have a pair of flat sections formed on opposite sides thereof to co-act with the first and second straight sections 191/192 of the biasing member 190 to serve as a detent when the shaft/handle member is in the unlocked position and also the forced-entry-resistant locked position (see FIG. 88 and FIG. 91).

Figure 25:
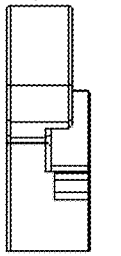
FIG. 25 is a first end view of the cam of FIG. 21.
Figure 29:
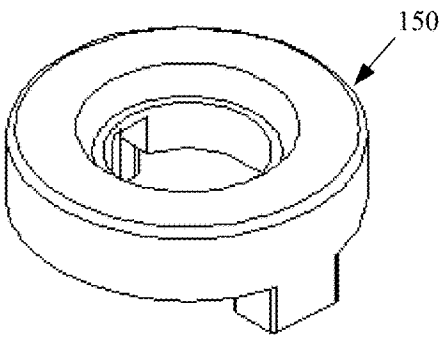
FIG. 29 is a bottom perspective view of the separation member of the forced-entry-resistant sash lock assembly of FIG. 1.
Figure 35:
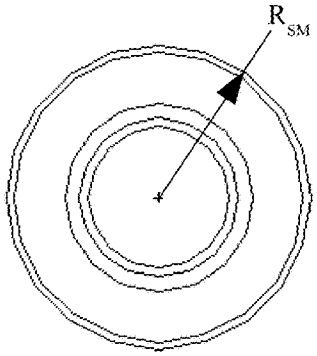
FIG. 35 is a rear view of the separation member of FIG. 29.
Figure 34:
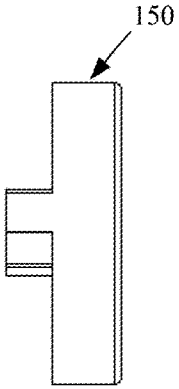
FIG. 34 is a second end view of the separation member of FIG. 29.
Figure 31:
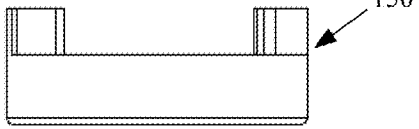
FIG. 31 is a top view of the separation member of FIG. 29.
Figure 30:
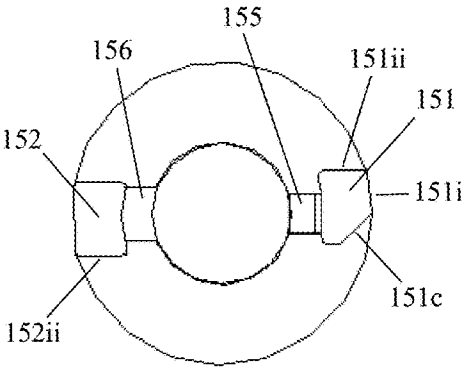
FIG. 30 is a front view of the separation member of FIG. 29.
Figure 32:
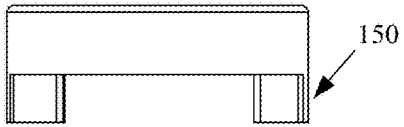
FIG. 32 is a bottom view of the separation member of FIG. 29.
Figure 28:
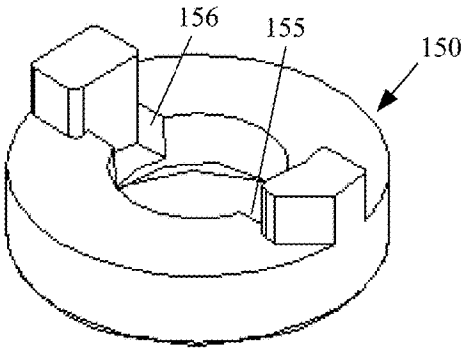
FIG. 28 is a top perspective view of the separation member of the forced-entry-resistant sash lock assembly of FIG. 1.
Figure 33:
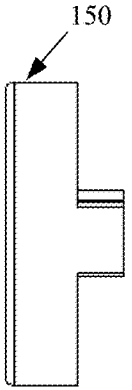
FIG. 33 is a first end view of the separation member of FIG. 29.
Figure 36:
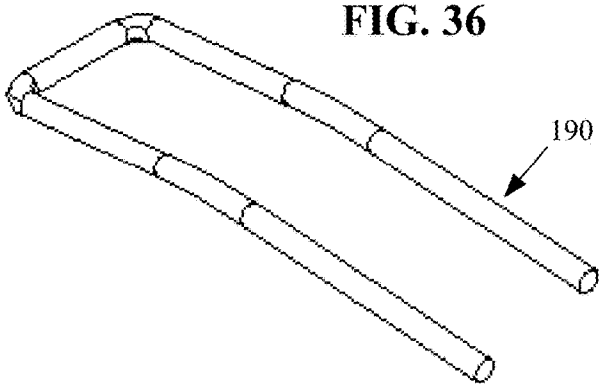
FIG. 36 a perspective view of the biasing member used for the forced-entry-resistant sash lock assembly of FIG. 1.
Figure 38:
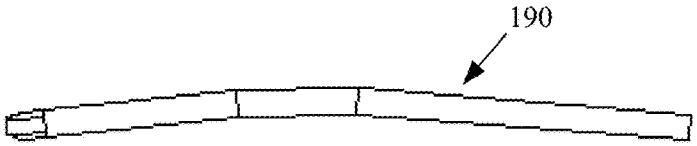
FIG. 38 is a top view of the biasing member of FIG. 36.
Figure 37:
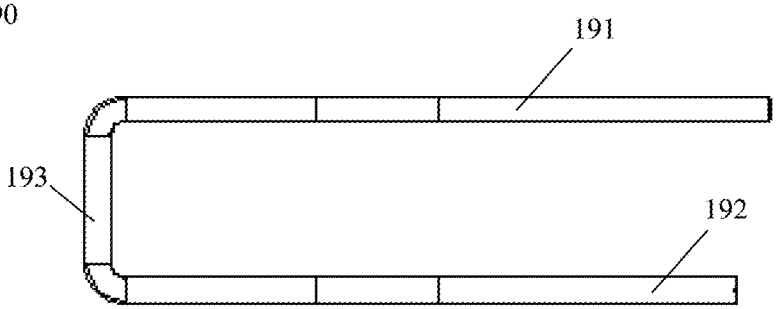
FIG. 37 is a front view of the biasing member of FIG. 36.
Figure 40:
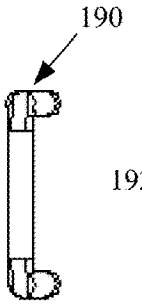
FIG. 40 is an end view of the biasing member of FIG. 36.
Figure 39:
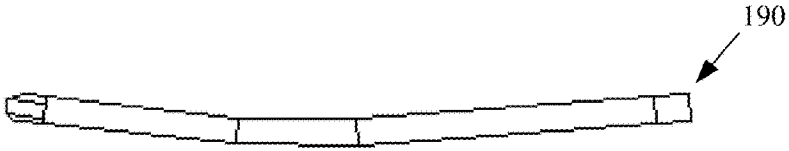
FIG. 39 is a bottom view of the biasing member of FIG. 36.

As seen in FIGS. 28-35, the separation member 150 may be formed of a suitable geometric shape. For simplicity, the overall shape of the separation member 150 may be the cylindrical shape shown in FIG. 29 and FIG. 25, which may have a radius $R_{SM}$ that may be sized to permit the separation member to be received within a recess in the cam, discussed hereinafter, for compact stack-up of the parts within the housing. The separation member 150 may also have a first recess 155 and second recess 156 that may correspondingly receive the two protrusions 141 and 142 of the shaft/handle member 140 for fixedly securing of those two parts together to ensure co-rotation of those parts. The separation member 150 may also have a protrusion 151 that may be formed to include a cam surface 151C, a first engagement surface 151*i*, and a second engagement surface 151*ii*, which may co-act with a corresponding recess of the cam 160. A second protrusion 152 may also be formed to include an engagement surface 152*ii*, which may also co-act with a corresponding recess of the cam 160 at the same time as the second engagement surface 151*ii* of the protrusion 151.

The cam 160, illustrated in FIGS. 19-27, may have a hub 163. The hub 163 may have a recess 167 formed on one side (see FIG. 27) to receive the separation member 150 therein (see FIG. 47 and FIG. 48), which recess may be elongated. The exterior surface 163E of the hub 163 may be cylindrical or may instead be elongated, as it has an elongated through opening 164 formed therein that is sized to permit the cam to thereby be movably mounted to the shaft 143 of the shaft/handle member 140 to permit relative rotation and/or translation. The elongated opening 164 may be one of several different elongated shapes, such as an oval-shaped opening, an elliptically-shaped opening, or a diamond shaped opening with rounded corners, but is preferably a slotted hole. The slotted hole is defined by a first half cylindrical surface with radius R and a second half cylindrical surface with radius R separated by two planar surfaces each having a length T. Extending laterally away from the hub 163 may be a wall 165, and extending laterally away from the wall 165 may be a curved cam wall 166, which may be used to engage a key of the corresponding keeper, and to draw the sliding sash window 99 in closer proximity to the master window frame 98 (or to the other sash window for a double-hung arrangement) and to lock the sash window. The side of the curved cam wall 166 closest to the hub may be formed with a flat section 166F that may have an extent that may be the same as the length T or which may be grater having a length T2, and which may be formed to be parallel to the planar surfaces of the slotted hole.

Figure 20:
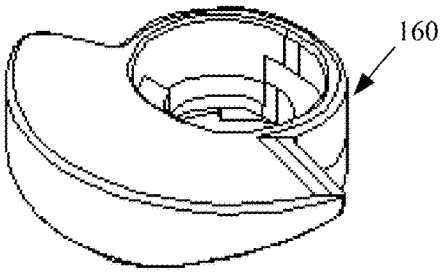
FIG. 20 is a second perspective view of the cam of the forced-entry-resistant sash lock assembly of FIG. 1.
Figure 19:
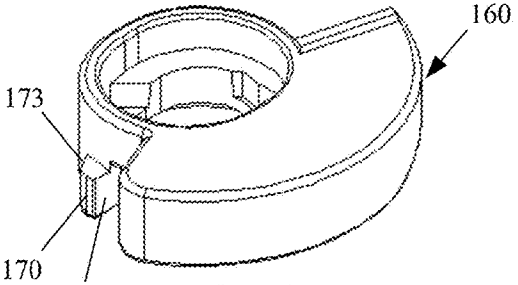
FIG. 19 is a first perspective view of the cam used for the forced-entry-resistant sash lock assembly of FIG. 1.
Figure 27:
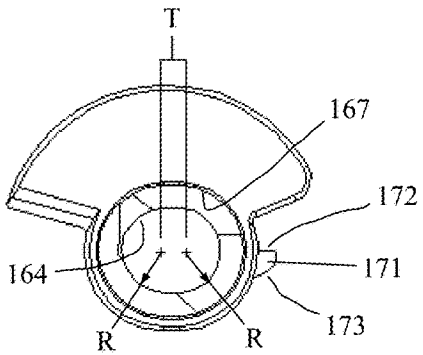
FIG. 27 is a rear view of the cam of FIG. 21.
Figure 26:
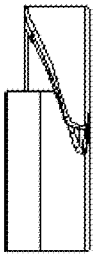
FIG. 26 is a second end view of the cam of FIG. 21.
Figure 23:
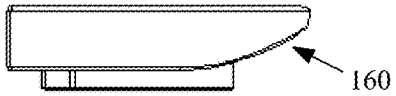
FIG. 23 is a top view of the cam of FIG. 21.
Figure 22:
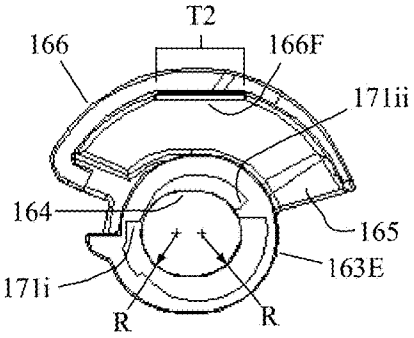
FIG. 22 is a front view of the cam of FIG. 21.
Figure 24:
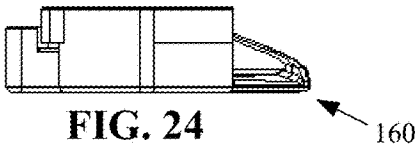
FIG. 24 is a bottom view of the cam of FIG. 21.

One side of the hub 163 (i.e., the side with the recess 167 that receives the separation member 150—see FIG. 20. FIG. 27, and FIG. 84A) may also be formed to have a particularly shaped opening that may include a first contact surface 161*i*, a second contact surface 16111, and a follower surface 161*f* between said first and second contact surfaces. The first and second contact surfaces 1611 and 161*ii* and the follower surface 161*f* within the hub 163 of the cam 160 may be formed relative to each other and at a selective position on one side of the hub, being clocked so as to be properly engaged, as discussed in detail hereinafter, by the cam surface 151C and first and second engagement surfaces 151*i* and 151*ii* of the protrusion 151 of the separation member 150, during various rotated positions of the shaft/handle member 140. The hub 163 may also be formed to have a second particularly shaped opening that may include a contact surface 161*i*, which may be engaged by the engagement surface 152*ii* of the protrusion 152 on the separation member 150.

Figure 89:
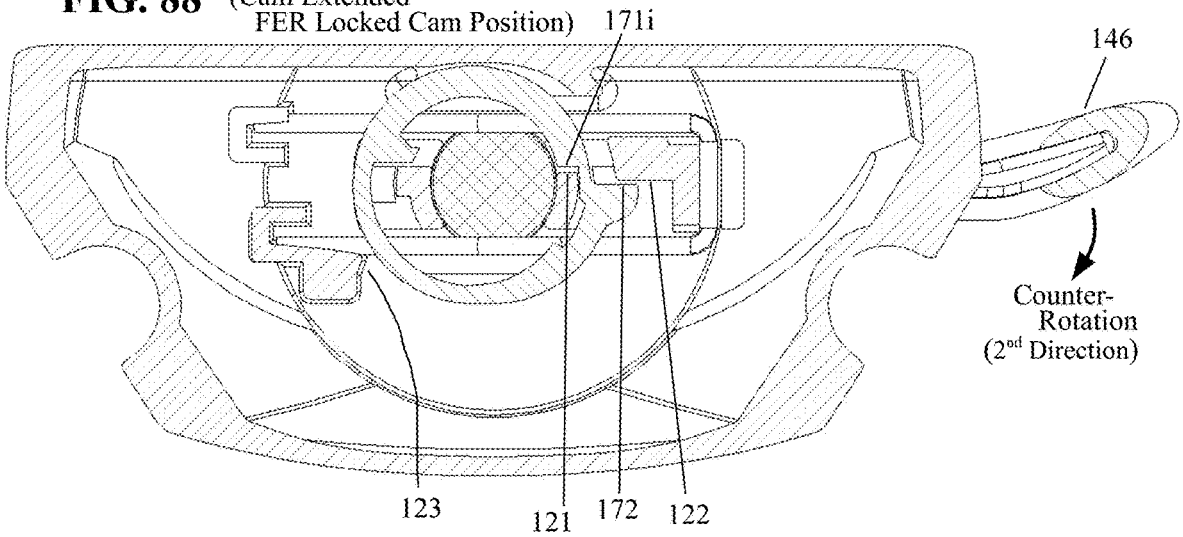
FIG. 89 is the cross-sectional view of FIG. 61 shown enlarged.
Figure 89:
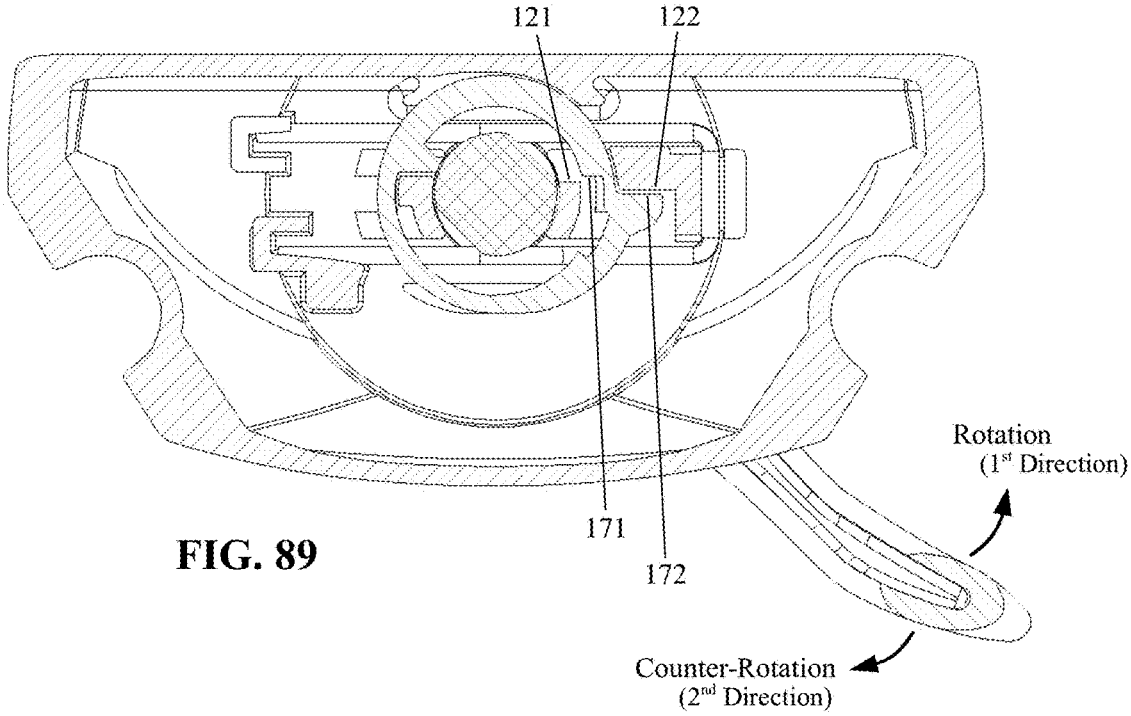
Figure 88A:
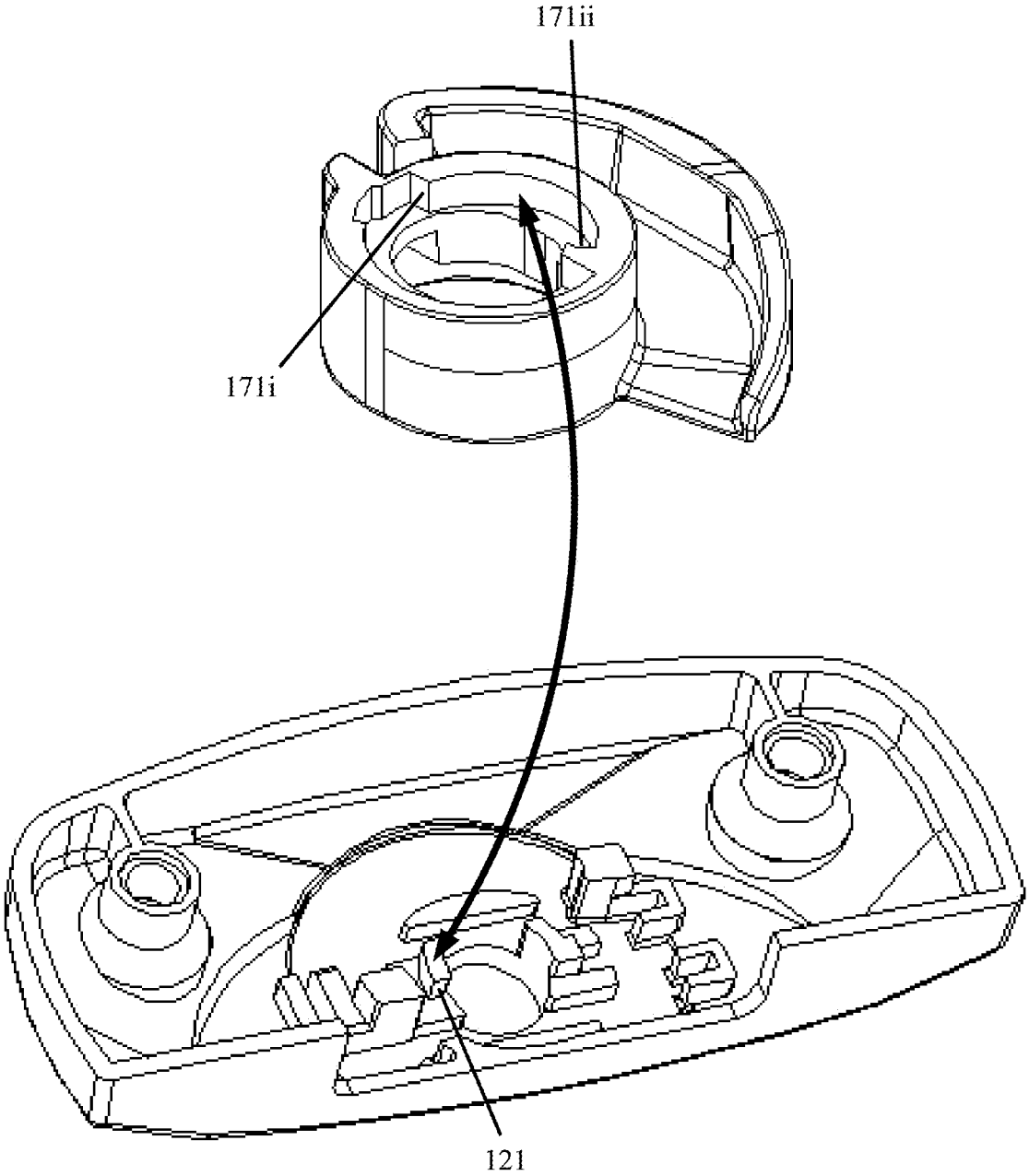
FIG. 88A shows the perspective view of the cam of FIG. 21 and the perspective view of the housing of FIG. 6, shown side-by-side, with arrows indicating the corresponding features that experience engagement/disengagement during movement of the shaft/handle member between the FER locked and the second unlocked positions.
Figure 90:
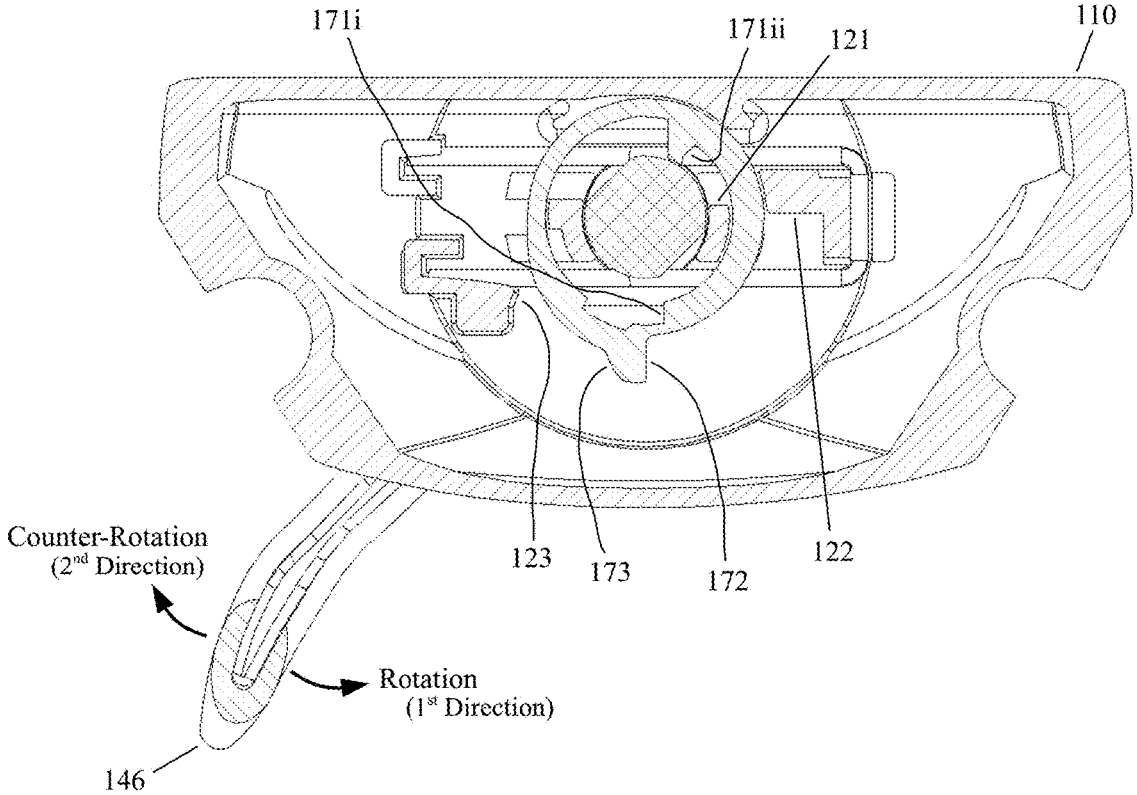
FIG. 90 is the cross-sectional view of FIG. 64 shown enlarged.
Figure 91:
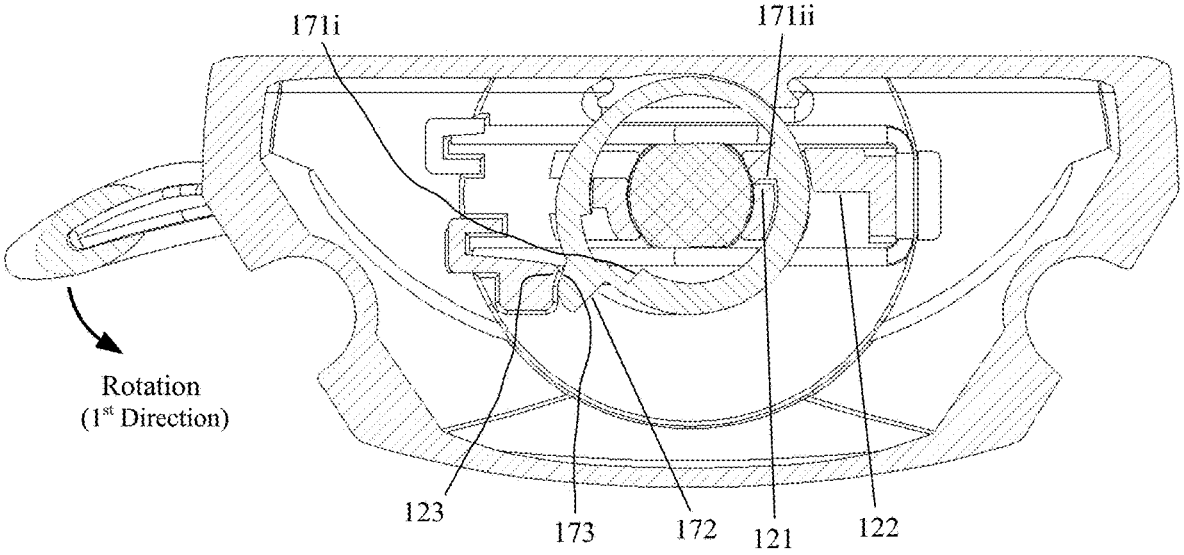
FIG. 91 is the cross-sectional view of FIG. 67 shown enlarged.

A second side of the hub 163 of the cam 160 may also be formed with a recess to create a first interior cam stop surface 171*i* that may contact/engage the housing stop surface 121 to prevent forced rotation of the cam from outside the window while in the FER locked position (see FIG. 88 and FIG. 88A), and which recess may also form a second interior cam stop surface 171*ii* that may also engage the housing stop surface 121 but limits travel of the shaft/handle member 140 at the unlocked position (see FIG. 91 and FIG. 88A). The exterior of the cam 160 may also be formed with a protrusion 170 that creates a first exterior cam stop surface 172 and a second exterior cam stop surface 173 that may respectively engage the housing stop surfaces 122 and 123 (see FIGS. 89, 90, and 91).

For ease in understanding the interactions of the cam and housing stops surfaces, each of those stop surfaces are identified in the intermediate position shown in FIG. 90 (i.e., housing stop surfaces 121, 122, and 123, and cam stop surfaces 171*i*, 171*ii*, 172, and 173).

The overall assembly sequence of the component parts that may be used for the sash lock 101 are shown in FIGS. 41-49.

The operation of the sash lock 101 by rotation of the shaft/handle member 140 from the forced-entry-resistant locked position (zero degrees of rotation) to the unlocked position (roughly 180 degrees of rotation) is shown in FIGS. 56, 59, 62, and 65. The corresponding interactions between the separation member 150 and the cam 160 during those 180 degrees of handle rotation is shown in FIGS. 57, 60, 63, and 66. The corresponding interactions between the cam 160 and the housing 110 is shown in FIGS. 58, 61, 64, and 67.

FIGS. 57, 60, 63, and 66 that show the interactions between the separation member 150 and the cam 160 during those 180 degrees of handle rotation (from forced-entry-resistant locked position to unlocked position) are respectively shown enlarged in FIGS. 84, 85, 86, and 87. FIGS. 58, 61, 64, and 67 that show the interactions between the cam 160 and the housing 110 during those 180 degrees of handle rotation (from forced-entry-resistant locked position to unlocked position) are respectively shown enlarged in FIGS. 88, 89, 90, and 91.

Figure 84:
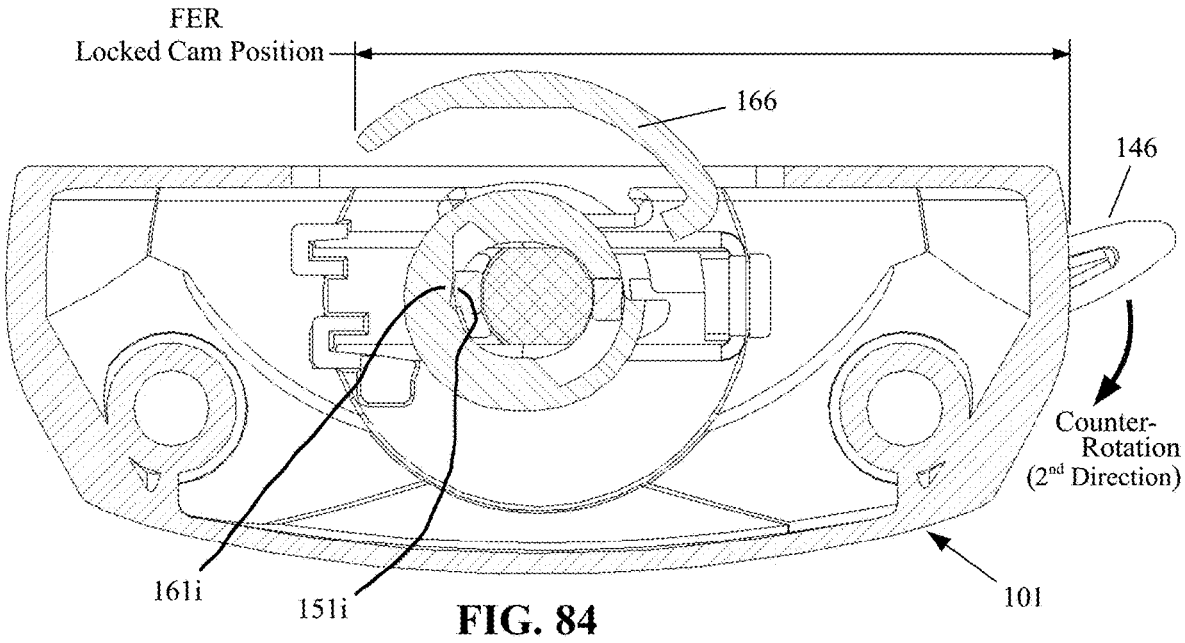
FIG. 84 is the cross-sectional view of FIG. 57 shown enlarged.
Figure 84A:
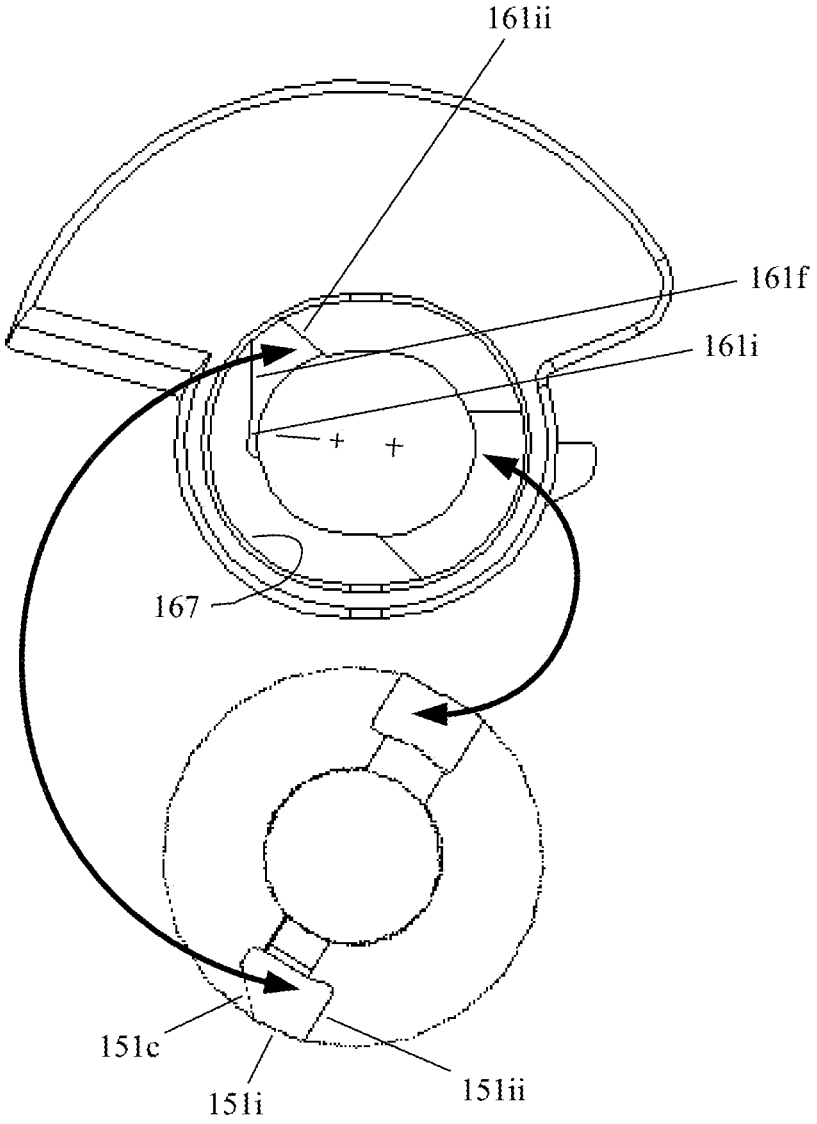
FIG. 84A shows the front view of the cam of FIG. 22 and the front view of the separation member of FIG. 30, shown side-by-side, with arrows indicating the corresponding features that experience engagement/disengagement during movement of the shaft/handle member between the FER locked and the second unlocked positions.
Figure 86:
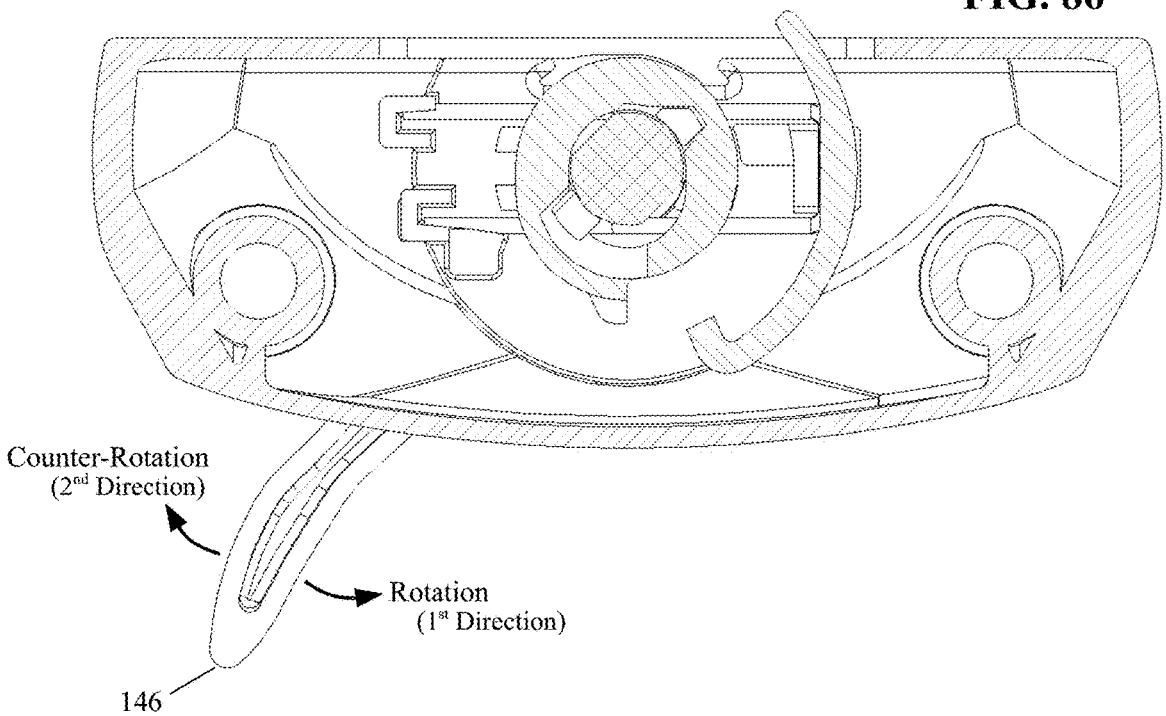
FIG. 86 is the cross-sectional view of FIG. 63 shown enlarged.

As seen in FIG. 84, with the shaft/handle member 140 in the forced-entry-resistant locked position (i.e., at zero degrees of rotation), the curved cam wall 166 may engage a key of the corresponding keeper to lock the sliding sash window 99 (i.e., prevents sliding). Although this engagement may prevent further movement of the shaft/handle member 140 beyond the forced-entry-resistant locked position (i.e., handle over-travel to the minus 20 degree position, being in a direction opposite to that shown by the arrow in FIG. 84 and in FIG. 88), such further movement is prevented by the stop surface 172 of the cam contacting the stop surface 122 of the housing. This stopped movement may also be beneficial to prevent damage to the sash lock engagement with the keeper, and may also be beneficial prior to when the sash lock is fixedly secured to the meeting rail of the sash window 99.

With the shaft/handle member 140 at the forced-entry-resistant locked position, the cam 150 is itself prevented from being forcibly counter-rotated into an unlocked position from outside the window by engagement of the stop surface 171*i* of the cam 160 with the stop surface 121 on the housing 110 (see FIGS. 84 and 88).

In addition, while at the forced-entry-resistant locked position, the cam 160 is prevented from being forcibly reverse-translated with respect to the shaft 143 of the shaft/handle member 140 due to the cam being pivotally mounted to the shaft using the elongated opening 164, which forced reverse-translation would cause disengagement of the cam stop surface 171*i* from the housing stop surface 121, thereby permitting forced counter-rotation. The cam 160 is prevented from being forcibly reverse-translated with respect to the shaft 143 of the shaft/handle member 140 by engagement of the engagement surface 151*i* of the separation member 150 with the contact surface 161*i* of the cam 160 (see FIG. 84).

As the shaft/handle member 140 is counter-rotated in the direction shown by the arrow in FIG. 84, approximately 45 degrees away from the zero degree forced-entry-resistant locked position, the engagement surface 151*i* of the separation member 150 disengages from the contact surface 161*i* of the cam 160, and then the cam surface 151*c* of the separation member moves relative to the follower surfaces 161*f* of the cam, which causes reverse-translation of the cam 160 until the engagement surface 151*ii* of the separation member reaches the contact surface 161*ii* of the cam (which may thereat be perpendicular to the translation direction), resulting in a translation amount T for the cam. (Note, the side of the curved cam wall 166 closest to the hub may be formed with the flat section 166F having a length T2 and to accommodate this translation relative to the key of the keeper). The shaft/handle member 140 and cam 160 are then in a non-FER locked position (FIG. 85), because the cam wall 166 still engages the key of the keeper to prevent sliding of the sash window 99, but the cam is not prevented from forced counter-rotation from the outside to unlock the window. The 45 degree rotation amount could be altered so that a different angular amount would be required for the sash lock 101 to reach the non-FER locked position.

As the 45 degree (non-FER locked) position is only an intermediate position, both the FER-locked and the unlocked positions are desirably indicated to the person actuating the handle by a detent mechanism (e.g., through the use of the first straight section 191 and second straight section 192 of the biasing member 190 that engage the flats 147/148 on the shaft 143 of the shaft/handle member 140 when at those positions).

Figure 85:
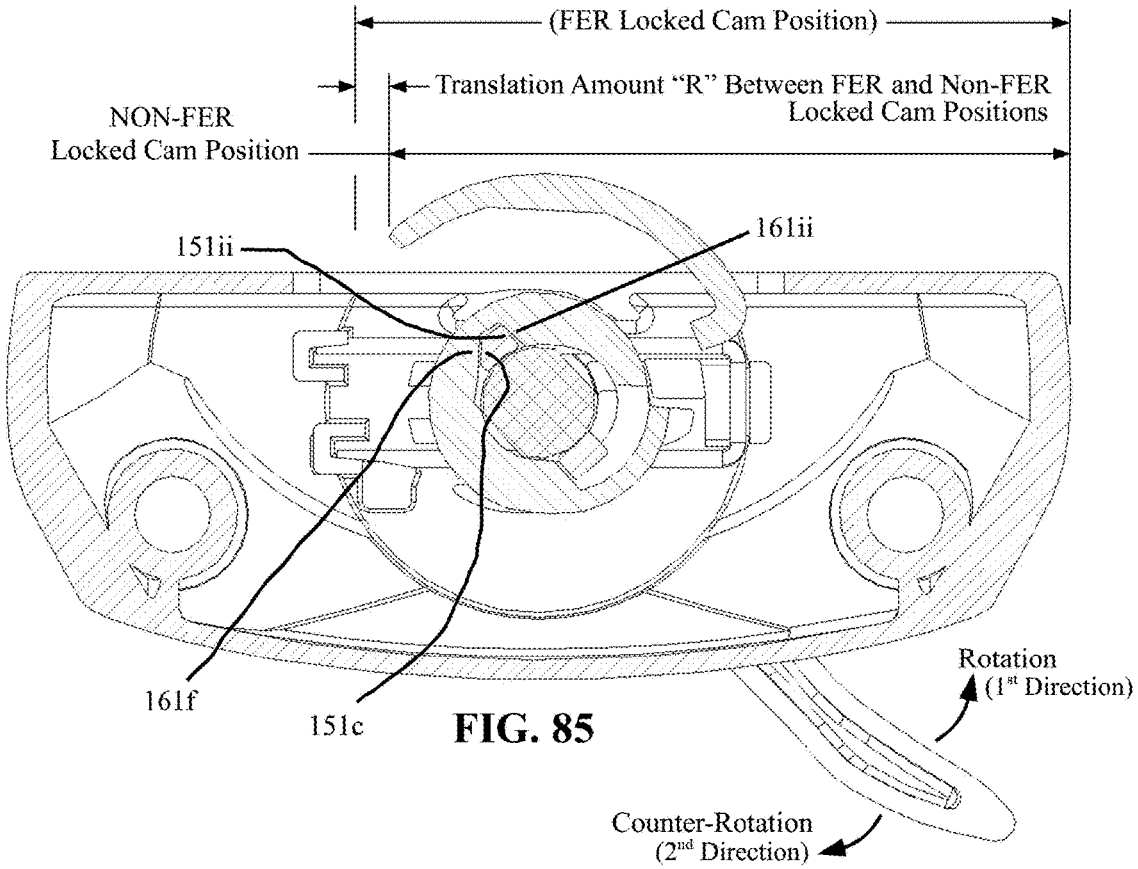
FIG. 85 is the cross-sectional view of FIG. 60 shown enlarged.

In seeking to unlock the sash window 99, the user of the sash lock 101 will naturally continue applying a force to the handle 146 of the shaft/handle member 140 to cause further counter-rotation past the intermediate (non-FER locked) position of FIG. 85. With such continued counter-rotation, the engagement surface 151*ii* of the separation member contacts the contact surface 161*ii* of the cam and drives the cam to co-counter-rotate to cause disengagement of the cam wall 166 from the key of the keeper, thereby permitting movement of the sash window 99. For more intuitive actuation of the sash lock 101 by a user, the counter-rotation of the shat/handle member 140 from the non-FER locked position to the detented unlock position may preferably be another 135 degrees (i.e., roughly 180 degrees of total shaft/handle member counter-rotation—see FIG. 87). Other rotation amounts could also be used. To limit the rotation of the shaft/handle member 140 to the desired 180 degrees (or to other angular amounts) of travel, the cam stop surface 173 is configured to contact the housing stop surface 123 upon reaching that desired 180 degrees of counter rotation (see FIG. 87). Alternatively, or additionally, to limit the rotation of the shaft/handle member 140 to the desired 180 degrees (or to other angular amounts) of travel, the cam stop surface 171*ii* is configured to contact the housing stop surface 121 upon reaching that desired 180 degrees of counter rotation (see FIG. 91).

Figure 87:
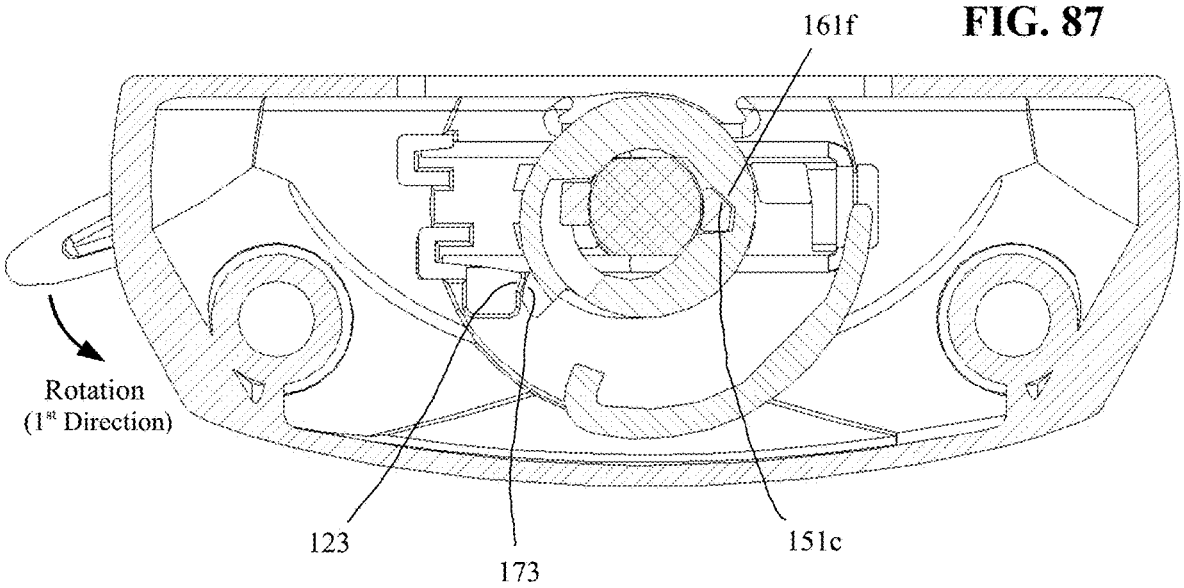
FIG. 87 is the cross-sectional view of FIG. 66 shown enlarged.

When the user seeks to actuate the sash lock 101 to once again lock the sash window 99 securely against a forced entry, the user may grasp the handle 146 when in the unlocked position of FIG. 87, and may apply a force in the direction of the arrow shown therein to initiate rotation in the opposite direction as caused the unlocking to occur. This application of force to cause the indicated rotation causes the cam surface 151*c* of the separation member to contact the follower surfaces 161*f* of the cam, and such contact drives the unrestrained cam 160 to co-rotate with the rotation of the shaft 143 through the intermediate positon shown in FIG. 86 and to the non-FER locked position shown in FIG. 85, where the cam wall 166 engages the key of the keeper, thereby inhibiting movement of the sash window 99. Upon reaching the non-FER locked position, continued rotation of the handle 146 causes the cam surface 151*e* of the separation member move relative to the follower surfaces 161*f* of the cam, as the cam 160 is retrained against further rotation by contact of the cam wall 166 with the keeper. Such relative movement between the cam surface 151*c* of the separation member and the follower surfaces 161*f* of the cam cause cam 160 that is restrained from rotation, to instead translate the amount T from the non-FER locked position of FIG. 85, to the FER locked position of FIG. 84. As the cam translates that amount T, the cam stop surface 171*i* engages the housing stop surface 121 (FIG. 88), thereby preventing forced counter-rotation, and the engagement surface 151*i* of the separation member 150 once again engages with the contact surface 161*i* of the cam 160 (FIG. 84), preventing forced reverse-translation of the cam with respect to the shaft 143 of the shaft/handle member 140.

In addition, to limit the rotation of the handle to the FER locked position shown in FIG. 84, the cam stop surfaces 172 is thereat configured to contact the housing stop surface 122.

While illustrative implementations of one or more embodiments of the disclosed apparatus are provided hereinabove, those skilled in the art and having the benefit of the present disclosure will appreciate that further embodiments may be implemented with various changes within the scope of the disclosed apparatus. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A forced-entry resistant sash lock for a sash window comprising:

a housing, said housing comprising: a wall shaped to form an exterior surface and an interior surface that defines a cavity, with a portion of said interior surface defining a stop surface; and a substantially cylindrical hole in said wall;

a substantially cylindrical shaft rotatably mounted in said substantially cylindrical hole in said wall of said housing;

a cam, said cam comprising a hub with a slotted hole configured to mount said cam on said substantially cylindrical shaft within said cavity of said housing for selective rotational and translational movement of said cam between a forced-entry-resistant locked cam position where a portion of said cam extends out from said housing cavity and engages a keeper to lock the sash window in a closed window position to inhibit sash window movement, a non-forced entry-resistant locked cam position where said portion of said cam still engages the keeper, and an unlocked position where said cam retracts into said housing and said portion of said cam disengages from the keeper; said cam comprising: a first contact surface, a second contact surface, a follower surface between said first and second contact surfaces, and a stop surface;

a separation member, said separation member comprising: a substantially cylindrical hole, a first engagement surface, a second engagement surface, and a cam surface between said first and second engagement surfaces; said separation member secured to said substantially cylindrical shaft whereby movement of said substantially cylindrical shaft causes corresponding movement of said separation member, with said securement configured for said first engagement surface, second engagement surface, and cam surface to respectively cooperate with said first contact surface, second contact surface, and follower surface;

wherein when said cam is in said unlocked position, upon rotation of said substantially cylindrical shaft in a first rotational direction said cam surface engages said follower surface and causes co-rotation of said cam into said non-forced entry-resistant locked cam position, and upon continued rotation of said substantially cylindrical shaft in said first rotational direction said cam surface of said separation member moves relative to said follower surface and causes translation of said cam into said forced-entry-resistant locked cam position through movement of said substantially cylindrical shaft within said slotted hole, until said first engagement surface engages said first contact surface;

wherein said translation of said cam causes said stop surface on said cam to engage said stop surface on said housing to prevent forced counter-rotation of said cam; and wherein said first engagement surface engaged with said first contact surface prevents forced reverse translation of said cam.

2. The forced-entry resistant sash lock according to claim 1, wherein when said cam is in said forced-entry-resistant locked cam position, upon counter-rotation of said substantially cylindrical shaft in a second rotational direction, corresponding counter-rotation of said separation member causes said first engagement surface to disengage from said first contact surface, and causes movement of said cam surface of said separation member relative to said follower surface to cause reverse translation of said cam from said forced-entry-resistant locked cam position to said non-forced entry-resistant locked cam position; and wherein upon continued counter-rotation of said substantially cylindrical shaft said second engagement surface contacts said second contact surface and causes co-counter-rotation of said cam from said non-forced entry-resistant locked cam position to said unlocked position.

3. The forced-entry resistant sash lock according to claim 2, wherein said slotted hole comprises a first half cylindrical surface and a second half cylindrical surface separated by two substantially planar surfaces.

4. The forced-entry resistant sash lock according to claim 3, wherein said housing comprises a second stop surface and said cam comprises a second stop surface; and wherein said second stop surface of said cam contacts said second stop surface of said housing to limit said counter-rotation of said cam in said second rotational direction upon reaching said non-forced entry-resistant locked cam position.

5. The forced-entry resistant sash lock according to claim 4, wherein said housing comprises a third stop surface and said cam comprises a third stop surface; and wherein said third stop surface of said cam contacts said third stop surface of said housing to limit said rotation of said cam in said first rotational direction upon reaching said unlocked position.

6. The forced-entry resistant sash lock according to claim 5, wherein said substantially cylindrical shaft comprises a graspable handle portion.

7. A forced-entry resistant sash lock for a sash window comprising:

a housing, said housing comprising: a stop surface, and a substantially cylindrical hole;

a substantially cylindrical shaft rotatably mounted in said substantially cylindrical hole;

a cam, said cam comprising an elongated opening configured to mount said cam on said substantially cylindrical shaft within a cavity of said housing for selective rotational and translational movement of said cam between a forced-entry-resistant locked position where a portion of said cam extends out from said cavity and engages a keeper to lock the sash window in a closed window position to inhibit sash window movement, a non-forced entry-resistant locked position, and an unlocked position where said cam retracts into said housing and said portion of said cam disengages from the keeper, said cam comprising: a first contact surface, a follower surface, and a stop surface;

a separation member, said separation member comprising: a substantially cylindrical hole, a first engagement surface and a cam surface; said separation member secured to said substantially cylindrical shaft whereby movement of said substantially cylindrical shaft causes corresponding movement of said separation member;

wherein when said cam is in said unlocked position, upon rotation of said substantially cylindrical shaft in a first rotational direction said cam surface engages said follower surface and causes co-rotation of said cam into said non-forced entry-resistant locked position, and upon continued rotation of said substantially cylindrical shaft in said first rotational direction said cam surface of said separation member moves relative to said follower surface and causes translation of said cam into said forced-entry-resistant locked position through movement of said substantially cylindrical shaft within said elongated opening, until said first engagement surface engages said first contact surface;

wherein said translation of said cam causes said stop surface on said cam to engage said stop surface on said housing to resist forced counter-rotation of said cam; and wherein said first engagement surface engaged with said first contact surface resists forced reverse translation of said cam.

8. The forced-entry resistant sash lock according to claim 7, wherein said separation member comprises a second engagement surface, and said cam comprises a second contact surface;

wherein when said cam is in said forced-entry-resistant locked position, upon counter-rotation of said substantially cylindrical shaft in a second rotational direction, corresponding counter-rotation of said separation member causes said first engagement surface to disengage from said first contact surface, and causes movement of said cam surface of said separation member relative to said follower surface to cause reverse translation of said cam from said forced-entry-resistant locked position to said non-forced entry-resistant locked position; and wherein upon continued counter-rotation of said substantially cylindrical shaft, said second engagement surface contacts said second contact surface and causes co-counter-rotation of said cam from said non-forced entry-resistant locked position to said unlocked position.

9. The forced-entry resistant sash lock according to claim 7, wherein said elongated opening is formed as a slotted hole; and wherein said slotted hole comprises a first half cylindrical surface and a second half cylindrical surface separated by two substantially planar surfaces.

10. The forced-entry resistant sash lock according to claim 7, wherein said housing comprises a second stop surface and said cam comprises a second stop surface; and wherein said second stop surface of said cam contacts said second stop surface of said housing to limit said counter-rotation of said cam in said second rotational direction upon reaching said non-forced entry-resistant locked position.

11. The forced-entry resistant sash lock according to claim 10, wherein said housing comprises a third stop surface and said cam comprises a third stop surface; and wherein said third stop surface of said cam contacts said third stop surface of said housing to limit said rotation of said cam in said first rotational direction upon reaching said unlocked position.

12. The forced-entry resistant sash lock according to claim 7, wherein said substantially cylindrical shaft comprises a graspable handle portion.

* * * * *